US010480171B2

(12) United States Patent
Miller et al.

(10) Patent No.: US 10,480,171 B2
(45) Date of Patent: Nov. 19, 2019

(54) CABLE FEED CONTROL MECHANISM FOR DRAIN CLEANER

(71) Applicant: MILWAUKEE ELECTRIC TOOL CORPORATION, Brookfield, WI (US)

(72) Inventors: Justin Miller, Milwaukee, WI (US); Ryan James Denissen, Sussex, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 261 days.

(21) Appl. No.: 15/661,043

(22) Filed: Jul. 27, 2017

(65) Prior Publication Data

US 2018/0030714 A1 Feb. 1, 2018

Related U.S. Application Data

(60) Provisional application No. 62/487,063, filed on Apr. 19, 2017, provisional application No. 62/367,223, filed on Jul. 27, 2016.

(51) Int. Cl.
*E03F 9/00* (2006.01)
*E03C 1/302* (2006.01)
(Continued)

(52) U.S. Cl.
CPC ..... *E03F 9/005* (2013.01); *B08B 9/045* (2013.01); *B65H 51/10* (2013.01); *E03C 1/302* (2013.01); *B65H 2701/391* (2013.01)

(58) Field of Classification Search
CPC ..... E03F 9/005; B08B 9/045; E03C 1/302; B65H 51/10; B65H 2701/391
See application file for complete search history.

(56) References Cited

U.S. PATENT DOCUMENTS 2,355,733 A 8/1944 Johnson et al.
2,930,584 A 3/1960 Hensley et al.
(Continued)

FOREIGN PATENT DOCUMENTS

CN 2464800 Y 12/2001
CN 203049728 U 7/2013
(Continued)

OTHER PUBLICATIONS

European Search Report for Application No. 17183628.1 dated Dec. 8, 2017 (15 pages).
(Continued)

*Primary Examiner* — Weilun Lo
(74) *Attorney, Agent, or Firm* — Michael Best & Friedrich LLP

(57) ABSTRACT

A drain cleaner including a cable configured to inserted in a drain, a drum supporting the cable, a motor configured to rotate the drum, and a cable feed control mechanism configured to feed the cable in a linear direction. The cable feed mechanism includes a plurality of feed wedges surrounding the cable, a plurality of rollers supported by the feed wedges, and a collar positioned around at least a portion of the plurality of feed wedges and having a cam surface. Each feed wedge has an inclined surface. Movement of the collar relative to the plurality of feed wedges causes the cam surface of the collar to engage the inclined surfaces of the plurality of feed wedges to move the plurality of feed wedges radially inward and into engagement with the cable.

20 Claims, 22 Drawing Sheets

(51) Int. Cl.
*B08B 9/045* (2006.01)
*B65H 51/10* (2006.01)

(56) References Cited

U.S. PATENT DOCUMENTS

| | | | | |
|---|---|---|---|---|
| 3,025,547 | A | 3/1962 | Ciaccio | |
| 3,075,217 | A | 1/1963 | Kollmann | |
| 3,159,861 | A | 12/1964 | Sarcone | |
| 3,206,782 | A | 9/1965 | Larsen | |
| 3,246,354 | A | 4/1966 | Cooney et al. | |
| 3,414,926 | A | 12/1968 | Bloom | |
| 3,449,782 | A | 6/1969 | Hunt | |
| 3,544,051 | A | 12/1970 | Norman | |
| 3,691,583 | A * | 9/1972 | Silverman | E03F 9/005 15/104.33 |
| 3,727,261 | A | 4/1973 | Levine | |
| 3,882,565 | A | 5/1975 | Irwin et al. | |
| 3,928,885 | A | 12/1975 | Peterson et al. | |
| 4,218,802 | A | 8/1980 | Babb et al. | |
| 4,356,557 | A | 10/1982 | Bell et al. | |
| 4,364,139 | A | 12/1982 | Babb et al. | |
| 4,395,791 | A | 8/1983 | Irwin | |
| 4,540,017 | A | 9/1985 | Prange | |
| 4,580,306 | A | 4/1986 | Irwin | |
| 4,686,732 | A | 8/1987 | Irwin | |
| 4,793,017 | A * | 12/1988 | Kaye | E03F 9/005 15/104.33 |
| 4,916,772 | A | 4/1990 | Russell et al. | |
| 4,956,889 | A | 9/1990 | Kirk | |
| 4,989,323 | A | 2/1991 | Casper et al. | |
| 5,009,242 | A | 4/1991 | Prange | |
| 5,029,356 | A | 7/1991 | Silverman et al. | |
| 5,031,263 | A | 7/1991 | Babb et al. | |
| 5,031,276 | A | 7/1991 | Babb et al. | |
| 5,414,888 | A * | 5/1995 | Irwin | E03F 9/005 15/104.33 |
| 5,526,975 | A | 6/1996 | Endo | |
| 5,901,401 | A | 5/1999 | Rutkowski et al. | |
| 6,076,219 | A | 6/2000 | Irwin | |
| 6,343,398 | B1 | 2/2002 | Silverman et al. | |
| 6,360,397 | B1 | 3/2002 | Babb | |
| 6,412,136 | B1 | 7/2002 | Rutkowski | |
| 6,470,525 | B1 * | 10/2002 | Silverman | B08B 9/045 15/104.33 |
| 6,615,436 | B1 | 9/2003 | Burch, Jr. et al. | |
| 6,637,064 | B2 | 10/2003 | Silverman et al. | |
| 6,655,228 | B1 | 12/2003 | Margherio et al. | |
| 6,745,487 | B1 | 6/2004 | Nield | |
| 7,007,399 | B2 | 3/2006 | Catalano | |
| 7,478,451 | B2 | 1/2009 | Rutkowski et al. | |
| 7,676,879 | B1 | 3/2010 | Rutenberg et al. | |
| 7,685,669 | B2 | 3/2010 | Rutkowski et al. | |
| 7,889,980 | B2 | 2/2011 | Sooy | |
| 8,046,862 | B2 | 11/2011 | Eisermann et al. | |
| 8,176,593 | B2 | 5/2012 | Gress et al. | |
| 8,413,347 | B2 | 4/2013 | Gress et al. | |
| 8,826,483 | B2 | 9/2014 | Rutkowski et al. | |
| 8,970,211 | B1 | 3/2015 | Olsson et al. | |
| 9,041,794 | B1 | 5/2015 | Olsson et al. | |
| 10,071,401 | B2 | 9/2018 | Dunkin et al. | |
| 2005/0193509 | A1 | 9/2005 | Rutkowski et al. | |
| 2007/0089254 | A1 | 4/2007 | Alaine | |
| 2008/0148503 | A1 | 6/2008 | Babb et al. | |
| 2008/0244816 | A1 | 10/2008 | Babb et al. | |
| 2008/0313831 | A1 | 12/2008 | Kovach et al. | |
| 2009/0211044 | A1 | 8/2009 | Hale et al. | |
| 2013/0160227 | A1 * | 6/2013 | Rutkowski | B08B 9/0436 15/104.33 |
| 2014/0202492 | A1 | 7/2014 | Grossman et al. | |
| 2017/0284078 | A1 * | 10/2017 | Puzio | B08B 9/045 |

FOREIGN PATENT DOCUMENTS

| | | | |
|---|---|---|---|
| CN | 203270721 | U | 11/2013 |
| CN | 203346973 | U | 12/2013 |
| CN | 104120767 | A | 10/2014 |
| CN | 204482269 | | 7/2015 |
| CN | 204482269 | U | 7/2015 |
| DE | 3423464 | | 1/1986 |
| DE | 10248411 | | 4/2004 |
| EP | 0683279 | | 11/1995 |
| WO | 2006112848 | | 10/2006 |
| WO | 2007008885 | | 1/2007 |
| WO | 2008124230 | | 10/2008 |
| WO | 2009143497 | | 11/2009 |
| WO | 2016106110 | | 6/2016 |

OTHER PUBLICATIONS

European Search Report for Application No. 17183622.4 dated Dec. 8, 2017 (10 pages).
European Patent Office Search Report for Application No. 17183628.1 dated Jun. 28, 2018, 14 pages.
International Search Report and Written Opinion for Application No. PCT/2019/012509 dated Apr. 23, 2019, 15 pages.
Chinese Patent Office Action for Application No. 201710625562.9 dated May 7, 2019, with English translation, 11 pages.
Chinese Patent Office Action for Application No. 201710625585.X, dated May 7, 2019, with English translation, 11 pages.

* cited by examiner

CABLE FEED CONTROL MECHANISM FOR DRAIN CLEANER

CROSS-REFERENCE TO RELATED APPLICATIONS

This application claims priority to U.S. Provisional Patent Application No. 62/367,223, filed Jul. 27, 2016, and to U.S. Provisional Patent Application No. 62/487,063, filed Apr. 19, 2017, the entire contents of both of which are incorporated by reference herein.

BACKGROUND

The present invention relates to drain cleaners, and specifically, to cable feed control mechanisms for drain cleaners.

Drain cleaners are used to clean dirt and debris out of drains or other conduits that collect debris in locations that are difficult to access. Drain cleaners typically have a cable or snake that is inserted into the drain to collect the debris. Some cables are manually fed into the drain, while others are driven into the drain by a motor.

SUMMARY

In one embodiment, the invention provides a drain cleaner including a cable configured to inserted in a drain, a drum supporting the cable, a motor configured to rotate the drum, and a cable feed control mechanism configured to feed the cable in a linear direction. The cable feed control mechanism includes a plurality of feed wedges surrounding the cable, with each feed wedge having an inclined surface, a plurality of rollers supported by the feed wedges, and a collar positioned around at least a portion of the plurality of feed wedges and having a cam surface. Movement of the collar towards the plurality of feed wedges causes the cam surface of the collar to engage the inclined surfaces of the plurality of feed wedges to move the plurality of feed wedges radially inward and into engagement with the cable.

In another embodiment, the invention provides a drain cleaner including a cable configured to inserted in a drain, a drum supporting the cable, a first motor configured to rotate the cable, and a cable feed control mechanism configured to feed the cable in a linear direction. The cable feed control mechanism includes a second motor, a drive wheel driven by the second motor, and a driven wheel. The drive wheel and the driven wheel are configured to selectively move the cable in the linear direction.

In yet another embodiment, the invention provides a drain cleaner including a cable configured to inserted in a drain, a drum supporting the cable, a motor configured to rotate the drum, and a cable feed control mechanism configured to limit linear movement of the cable. The feed control mechanism includes a plurality of clamping wedges surrounding the cable, with each clamping wedge having an inclined surface, and a collar positioned around a least a portion of the plurality of clamping wedges and having a cam surface. The movement of the collar towards the plurality of clamping wedges causes the cam surface of the collar to engage the inclined surfaces of the plurality of plurality of clamping wedges to move the clamping wedges radially inward and into engagement with the cable.

In yet another embodiment, the invention provides a drain cleaner including a cable configured to inserted in a drain, a drum supporting the cable, a motor configured to rotate the drum, and a cable feed control mechanism configured to selectively feed the cable in a linear direction and limit the movement of the cable. The cable feed control mechanism includes a plurality of feed wedges surrounding the cable, with each feed wedge having a first inclined surface, a plurality of rollers supported by the feed wedges, a plurality of clamping wedges surrounding the cable, with each clamping wedge having a second inclined surface, a collar positioned around at least portions of the plurality of feed wedges and the plurality of clamping wedges and having a first cam surface and a second cam surface, and a sleeve coupled to the collar and operable to move the collar. Movement of the sleeve in a first direction causes movement of the collar towards the plurality of feed wedges such that the first cam surface of the collar engages the first inclined surfaces of the plurality of feed wedges to move the plurality of feed wedges radially inward and into engagement with the cable, and movement of the sleeve in the second direction causes movement of the collar towards the plurality of clamping wedges such that the second cam surface of the collar engages the second inclined surfaces of the plurality of clamping wedges to move the clamping wedges radially inward and into engagement with the cable.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
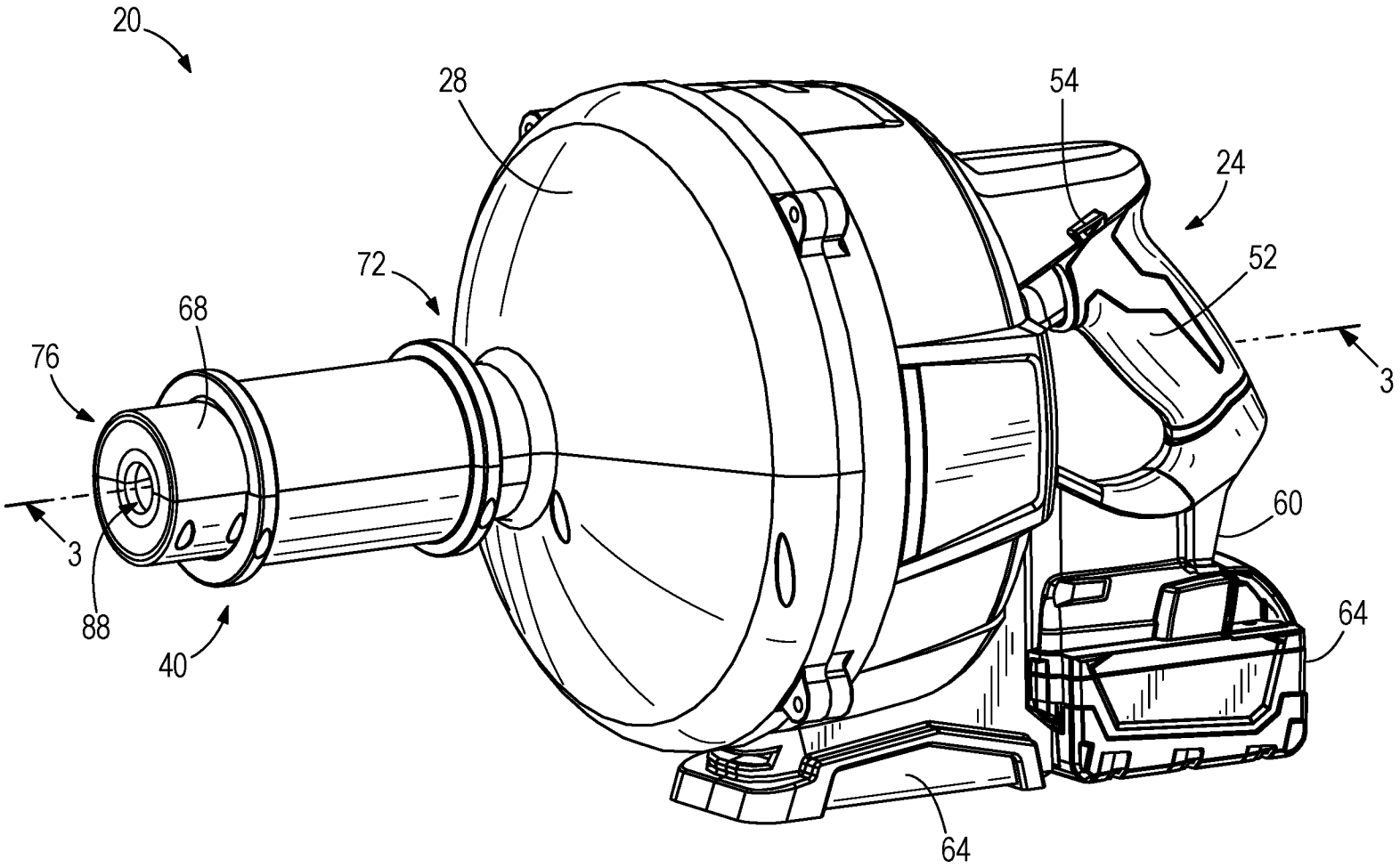
FIG. 1 is a perspective view of a drain cleaner according to one embodiment.
Figure 2:
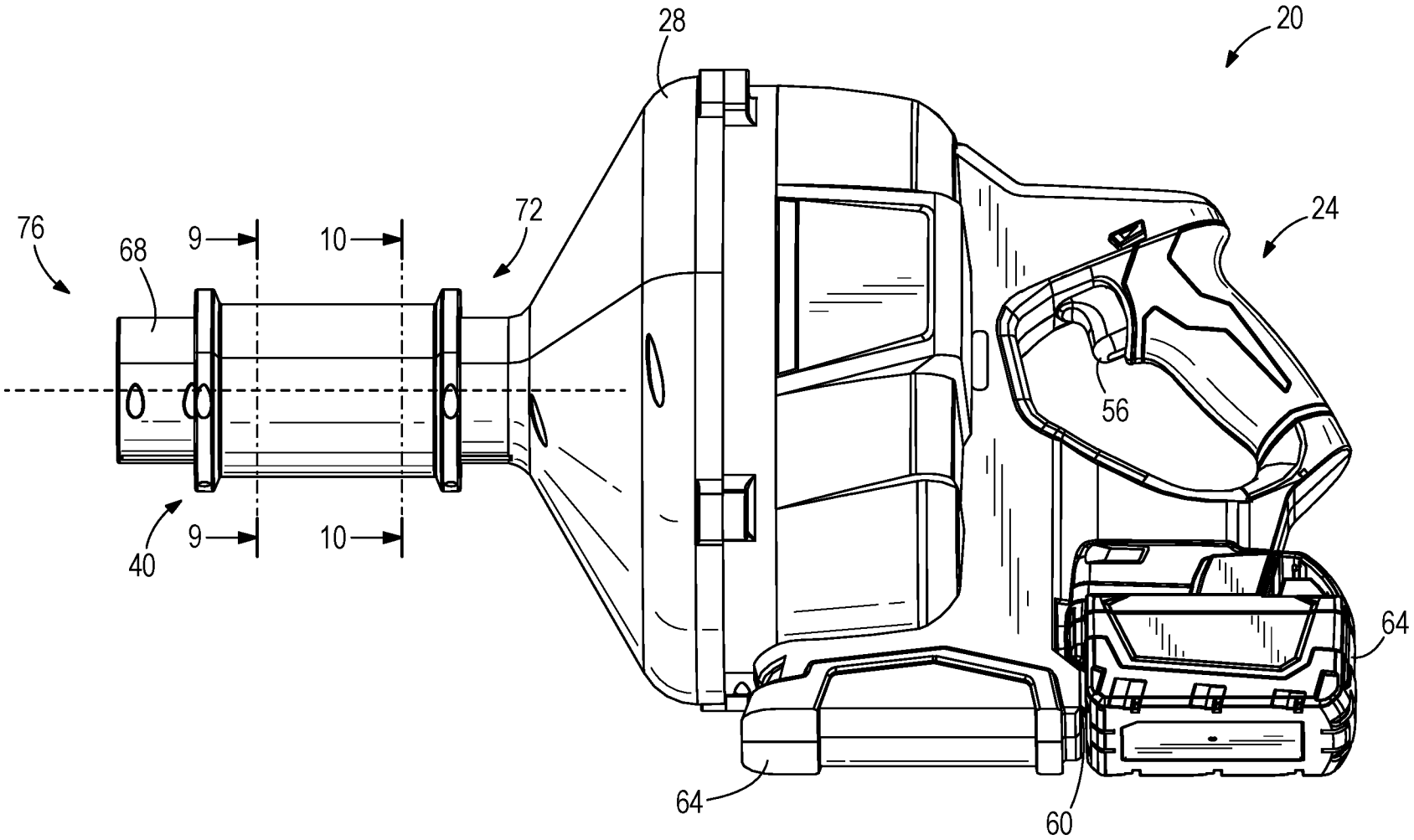
FIG. 2 is a side view of the drain cleaner of FIG. 1.
Figure 3:
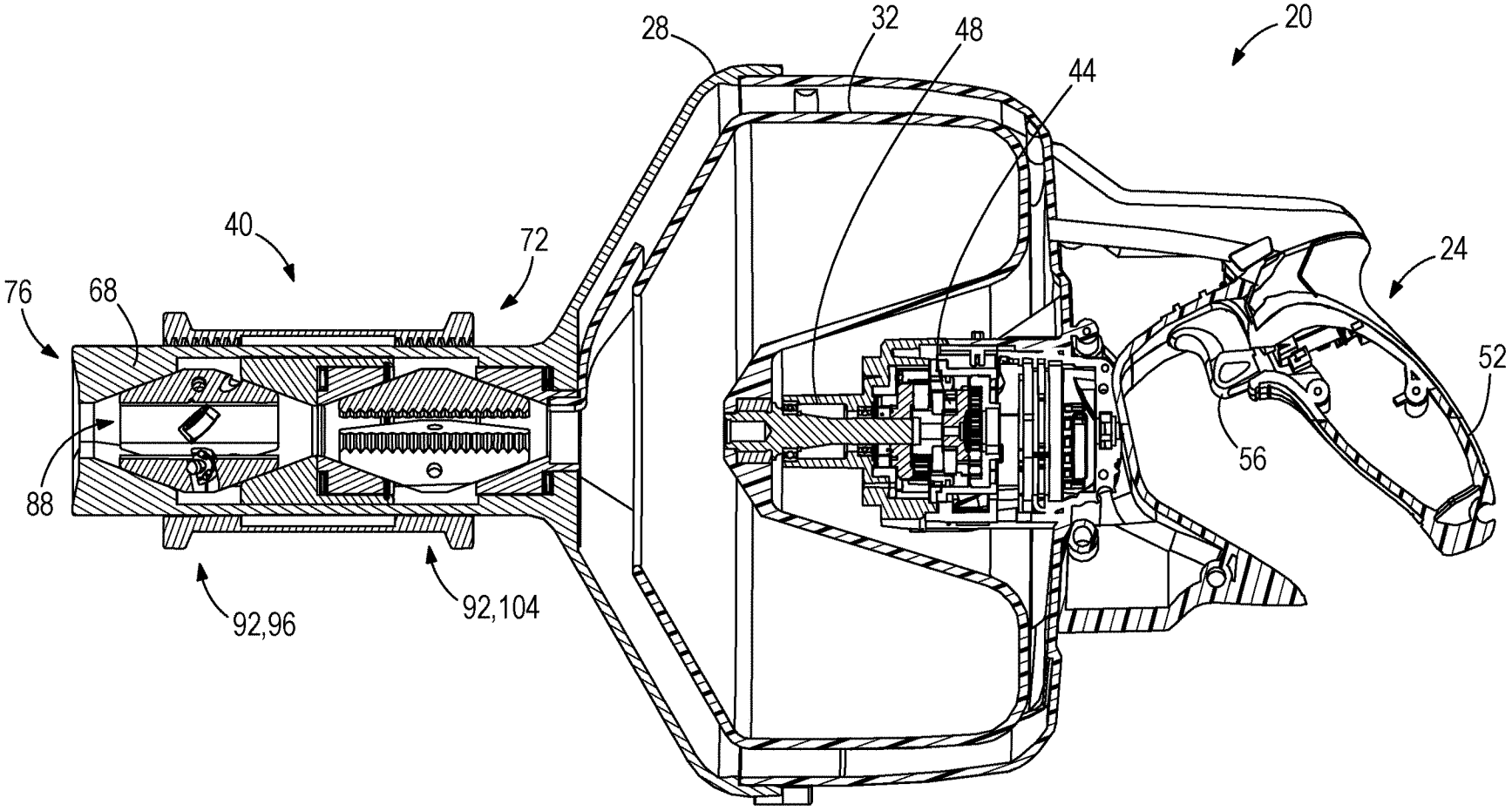
FIG. 3 is a cross-section of the drain cleaner taken along section line 3-3 of FIG. 1.

FIGS. 1-3 illustrate a drain cleaner 20. The illustrated drain cleaner 20 includes a handle assembly 24, a shroud 28, a drum 32 (FIG. 3), and a nose assembly 40. In one embodiment, the shroud 28 may be a drum shield. As shown in FIG. 3, the drain cleaner 20 also includes a motor 44 and a drive mechanism 48 for rotating the drum 32. The drain cleaner 20 further includes a flexible cable 50 (FIGS. 11-12) that is stored within the drum 32 and extends out of the nose assembly 40. The cable 50 is insertable into a drain, or other conduit, for cleaning the drain. The illustrated cable 50 is formed similar to a spring in which a long wire is shaped into a helix. The helical pattern helps to grip debris. The pitch of the helix determines how tight or loose the cable 50 is and whether there is any space between each turn of the helix. In other embodiments, the cable 50 is not helical and may include other textures or gripping elements (e.g., protrusions or the like). In some embodiments, the cable 50 may include an auger head or other tool attachment at its distal end.

The handle assembly 24 extends rearwardly from the shroud 28. The handle assembly 24 includes a grip 52 that is configured to be grasped by a user for carrying and operating the drain cleaner 20. The handle assembly 24 supports an actuator 56 (e.g., a trigger) adjacent the grip 52 and a forward/reverse shuttle or button 54 adjacent the grip 52. The actuator 56 is actuatable (e.g., depressible) by a user to selectively energize the motor 44 and, thereby, operate the drain cleaner 20. The forward reverse shuttle 54 is moveable between a first position in which the motor 44 rotates in a first rotational direction and a second position in which the motor rotates in a second rotational direction. The illustrated handle assembly 24 also includes a battery receptacle 60 for receiving and supporting a battery pack 64. The battery receptacle 60 includes terminals that electrically connect the battery pack to the motor 44 and the actuator 56. In other embodiments, the handle assembly 24 may support a power cord to electrically connect the motor 44 to an AC power source.

The illustrated handle assembly 24 further includes a stand 64. In one embodiment, the stand 64 is a base. The stand 64 is positioned generally beneath the shroud 28 and the motor 44. More particularly, the stand 64 is positioned beneath a center of gravity of the drain cleaner 20. The stand 64 is configured to engage and rest on a support surface (e.g., a table, a workbench, a countertop, the floor, etc.) to provide ease of use during operation.

The shroud 28 is coupled to the handle assembly 24 generally above the stand 64. The shroud 28 is fixed to the handle assembly 24 such that the shroud 28 is stationary (i.e., does not rotate or otherwise move) relative to the handle assembly 24 during operation of the drain cleaner 20. The shroud 28 is positioned around the drum 32 to help protect the drum 32. Further, the shroud 28 protects a user from the spinning drum 32, and provides ease of use if the user supports the drain cleaner 20 with his/her body 156 during operation (e.g., rests the drain cleaner 20 on a knee or hip).

As shown in FIG. 3, the drum 32 is positioned substantially within the shroud 28. The drum 32 is configured to rotate within the shroud 28. The drum 32 is coupled to the drive mechanism 48 such that rotation of the motor 44 is transmitted to the drum 32 through the drive mechanism 48. The drum 32 may be coupled to the drive mechanism 48 using any suitable means to transmit force (e.g., rotation) from the drive mechanism 48 to the drum 32. Rotation of the drum 32 results in rotation of the cable 50. Specifically, in the illustrated embodiment, friction between the inner surface of the drum 32 and the cable 50 causes the cable 50 to rotate or spin with the drum 32.

Figure 4:
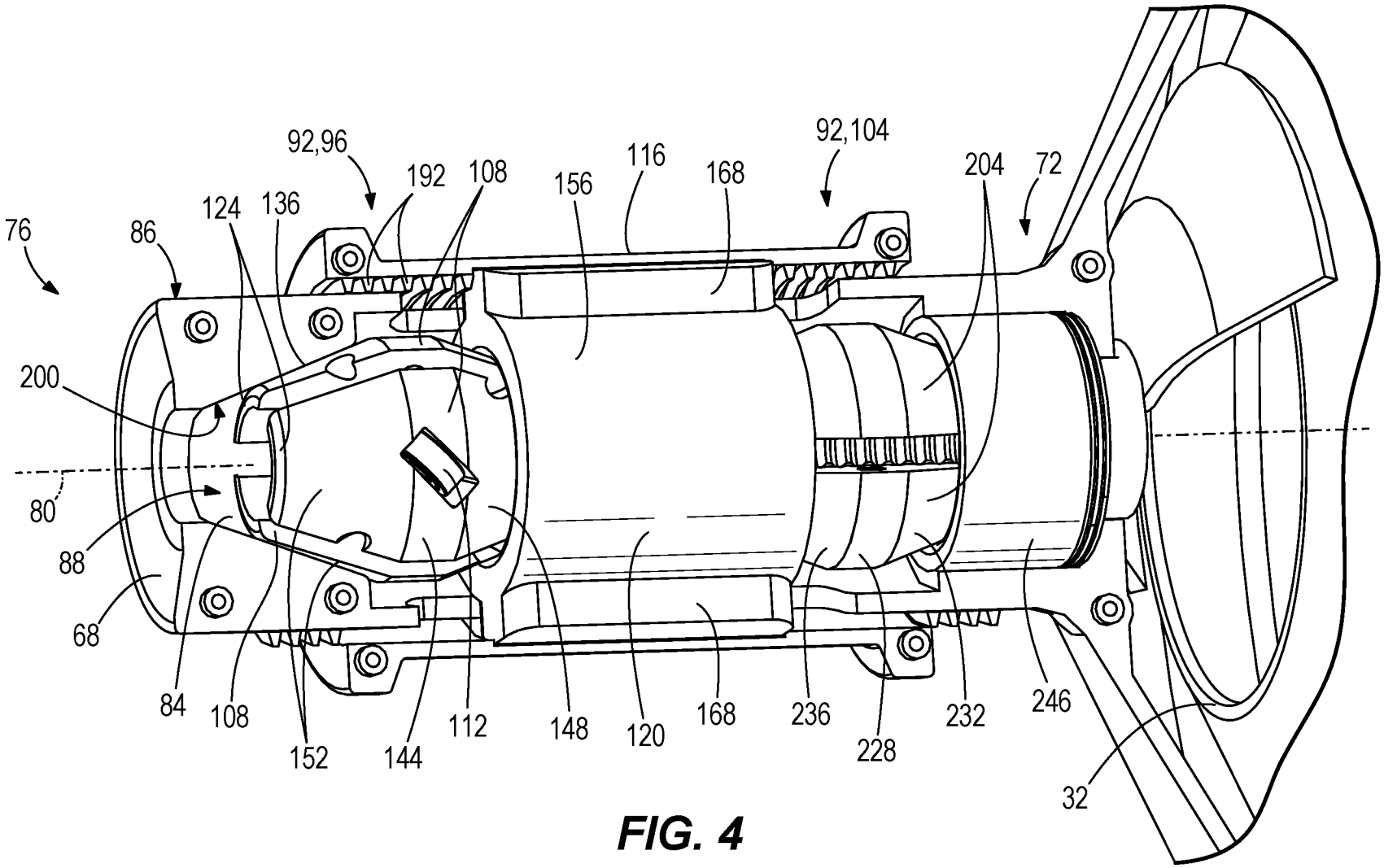
FIG. 4 is an enlarged view of a cable feed control mechanism according to one embodiment, including a passive feed mechanism and a cable limiting mechanism.
Figure 5:
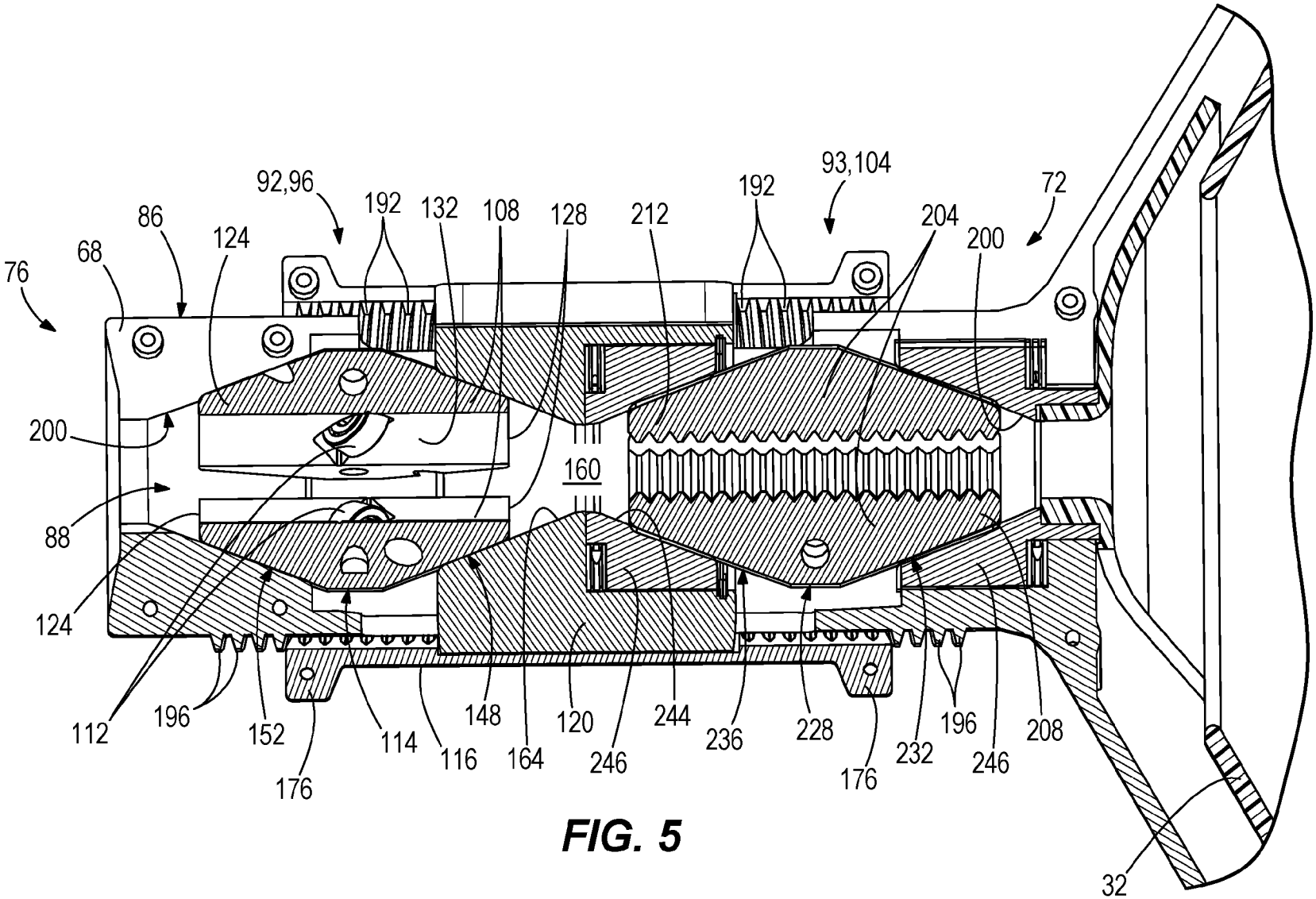
FIG. 5 is an enlarged cross-section of the cable feed control mechanism, including the passive feed mechanism and the cable limiting mechanism.

The nose assembly 40 extends from the shroud 28 in a direction away from the handle assembly 24. More specifically, the nose assembly 24 extends from a first end 72 that is proximal to the shroud 28 to a second end 76 that is distal from the shroud 28. As shown in FIGS. 4 and 5, the nose assembly 40 includes a tube 68 that has a generally cylindrical shape with an interior surface 84 and an exterior surface 86. The tube 68 is elongated and defines a feed axis 80 extending longitudinally through the tube 68. The tube 68 has a partially hollow interior that creates a passageway for receiving the cable 50. The tube 68 guides the cable 50 from the drum 32, where the cable 50 is coiled, to an outlet 88 of the drain cleaner 20, where the cable 50 can exit the drain cleaner 20 and extend into a drain. The cable 50 is fed into and out of the drain cleaner 20 along the feed axis 80. More specifically, the cable 50 is extended into the drain by moving linearly along the feed axis 80 in a first direction. Similarly, the cable 50 is retracted by moving linearly along the feed axis 80 in a second direction opposite the first direction.

The drain cleaner 20 further includes one or more feed control mechanisms 92. In the illustrated embodiment, the feed control mechanisms 92 operate to control the linear movement of the cable 50. As will be described in further detail below, the feed control mechanisms 92 can include a passive feed mechanism 96 (FIGS. 4-5), an active feed mechanism 100 (FIGS. 4-5), and a feed limiting mechanism 104 (FIGS. 4-5). In some embodiments, the feed control mechanisms 92 can be used to automatically feed the cable 50 into and out of the drain without a user having to manually feed the cable 50 into the drain. Additionally, in some embodiments, the feed control mechanisms 92 can be used to extend the cable 50 into the drain as well as retract the cable 50 out of the drain and into the drum 32. In other embodiments, the feed control mechanisms 92 are only capable of feeding the cable 50 in one direction.

Figure 6:
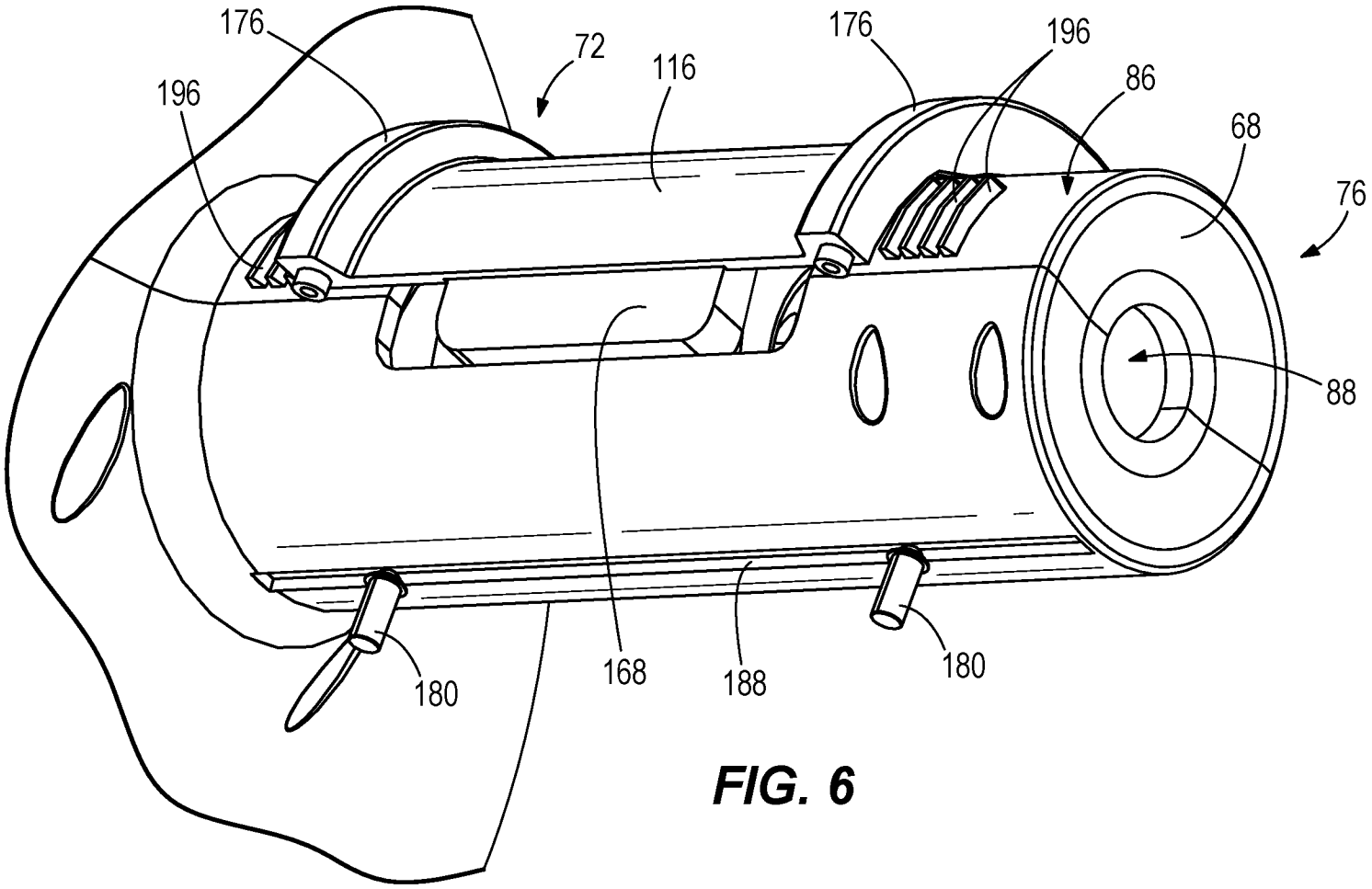
FIG. 6 is an enlarged view of a retaining mechanism of the cable feed control mechanism.

With reference to FIGS. 4-6, the passive feed mechanism 96 is substantially housed within the tube 68. The illustrated passive feed mechanism 96 includes a set of feed wedges 108, a set of rollers 112, a sleeve 116, and a collar 120. The feed wedges 108 are disposed within the tube 68, and are positioned around the feed axis 80 in a circular arrangement. The feed wedges 108 are spaced apart from the feed axis 80 to allow enough room for the cable 50 to extend through the circular arrangement along the feed axis 80. In the illustrated embodiment, three feed wedges 108 are used to form the circular arrangement. In other embodiments, additional feed wedges 108 may be used.

Figure 9:
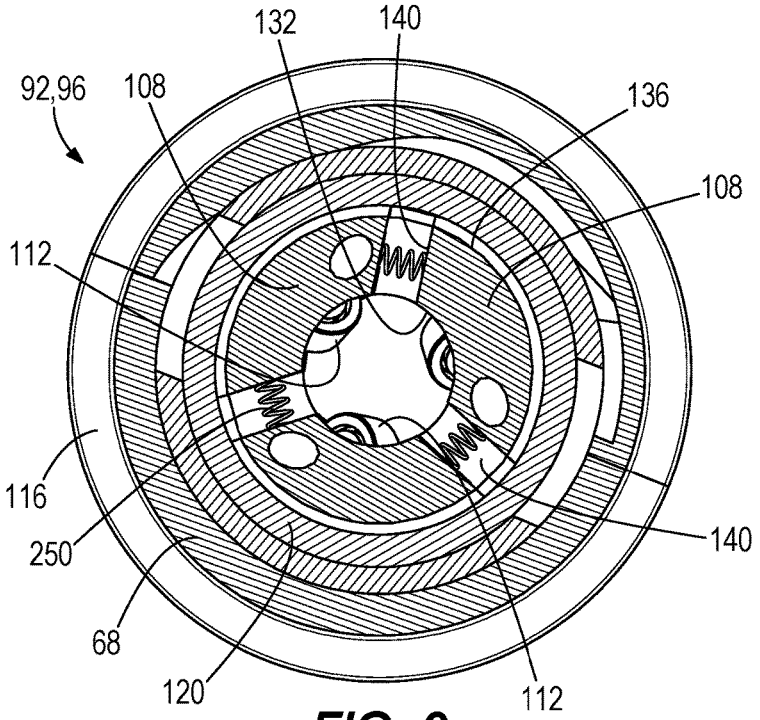
FIG. 9 is a cross-sectional view of the passive feed mechanism taken along section line 9-9 of FIG. 2.

The illustrated feed wedges 108 each include a first end 124 and a second end 128. The feed wedges 108 are oriented so that the first end 124 and the second end 128 are axially spaced apart along the feed axis 80. The feed wedges 108 also include an inner wall 132, an outer wall 136, and two side walls 140 (FIG. 9). Each of these walls 132, 136, 140 extends between the first end 124 and the second end 128. In the illustrated embodiment, the inner wall 132 faces radially inward towards the center of the circular arrangement. The outer wall 136 faces radially outward away from the center of the circular arrangement. The side walls 140 extend between the inner wall 132 and the outer wall 136.

The inner wall 132 is curved in the direction generally perpendicular to the feed axis 80 (i.e., curved circumferentially around the feed axis 80). In other words, when viewed from a cross-section perpendicular to the feed axis 80, the inner wall 132 is concave (FIG. 9). The inner wall 132 is straight in the direction generally parallel to the feed axis 80 (FIG. 5).

As shown in FIGS. 4 and 6, the outer wall 136 is curved in the direction generally perpendicular to the feed axis 80. However, when viewed from the direction generally parallel to the feed axis 80, the outer wall 136 includes a straight surface 144, a first inclined surface 148, and a second inclined surface 152 (FIG. 5). The straight surface 144 is generally parallel to the feed axis 80, and is located between the first inclined surface 148 and the second inclined surface 152. The first inclined surface 148 is proximate the first end 124 of the feed wedge 108, and tapers radially inward towards the first end 124. The second inclined surface 152 is proximate the second end 128 of the feed wedges 108, and tapers radially inward towards the second end 128. Accordingly, when viewed from a cross section parallel to the feed axis 80, the feed wedge 108 forms a triangular shape with a flat peak.

The side walls 140 are generally planar. The feed wedges 108 are arranged relative to one another so that the side walls 140 of each feed wedge 108 are aligned generally parallel to a side wall 140 of an adjacent feed wedge 108. In addition, the feed wedges 108 are biased radially outward and away from one another so that adjacent side walls 140 are not in contact when in a neutral position. In the illustrated embodiment, the feed wedges 108 are biased outwardly by springs (not shown) that extend into bores in the side walls 140 of adjacent feed wedges 108 to hold the feed wedges 108 apart. Although the springs and bores are not illustrated in the passive feed mechanism 96, a similar feature is illustrated in the feed limiting mechanism 104 (see FIG. 10). As will be discussed in greater detail below, the feed wedges 108 can be moved radially inward by a counterforce that overcomes the outward biasing force. In some embodiments, the side walls 140 of adjacent feed wedges 108 come in contact with one another when the feed wedges 108 are forced radially inward. In other embodiments, the side walls 140 are moved closer to one another but do not come in contact.

The rollers 112 are supported by the feed wedges 108. In the illustrated embodiment each feed wedge 108 supports one roller 112, and thus, the rollers 112 are also arranged in a circular pattern around the feed axis 80. In other embodiments, more than one roller 112 can be supported by each feed wedge 108. The rollers 112 are disposed within an opening in each feed wedge 108. The rollers 112 are supported by the feed wedges 108 in a manner than enables the rollers 112 to spin relative to the feed wedge 108. Specifically, the rollers 112 are rotably coupled to the feed wedges 108. In some embodiments, the rollers 112 are coupled to the feed wedge 108 by a pin that extends through the center of each roller 112 and into the body 156 of the feed wedge 108. In other embodiments, different mechanisms can be used to rotatably couple the rollers 112 to the feed wedges 108.

The rollers 112 are configured to selectively engage the cable 50 to help feed the cable 50 into or out of the drain. More specifically, when the feed wedges 108 are forced radially inward, the rollers 112 move inward with the feed wedges 108 and can engage the cable 50. As the cable 50 is rotated by the motor 44, the rollers 112 frictionally engage the cable 50 to move the cable 50 in a linear direction. When the inward radial force is removed, the feed wedges 108 return to their outwardly biased position and the rollers 112 disengage from the cable 50. In some embodiments, the rollers 112 can be arranged so that the axis of rotation each roller 112 is at an oblique angle relative to the feed axis 80 and the cable 50. For example, in one embodiment, the rollers 112 are oriented at an angle that matches the pitch of the helical pattern of the cable 50. In other embodiments, the rollers 112 are oriented at a 45 degree angle relative to the feed axis 80. In further embodiments, the rollers 112 may be oriented at other angles relative to the feed axis 80. The angle of the rollers 112 can help increase the friction with the cable 50, or can affect the speed at which the cable 50 is fed. In one embodiment, the cable 50 is fed at speeds of 5 inches per second or faster. In another embodiment, the cable 50 is fed at speeds between 6 inches per second and 10 inches per second. In yet another embodiment, the cable 50 is fed at a speed of 7 inches per second.

With continued reference to FIGS. 4 and 5, the collar 120 and the sleeve 116 can be used to force the feed wedges 108 radially inward to selectively engage the rollers 112 with the cable 50. The illustrated collar 120 includes a cylindrical body 156 having a partially hollow interior space 160 defined by an interior wall. The first ends 124 of the feed wedges 108 are at least partially received within the interior space 160 of the cylindrical body 156. The interior wall includes an angled surface that forms a first cam surface 164. The first cam surface 164 is configured to align with the first inclined surfaces 148 of the feed wedges 108 such that the first cam surface 164 and the first inclined surfaces 148 are generally parallel. In the illustrated embodiment, the first cam surface 164 is conical, with the widest portion of the cone opening toward the feed wedges 108. In other embodiments, the first cam surface 164 includes a plurality of first cam surfaces 164, with each of the plurality of first cam surfaces 164 configured to engage with one or more of the first inclined surfaces 148. The collar 120 further includes a pair of arms 168 extending radially outward from the cylindrical body 156. The illustrated collar 120 includes two arms 168 extending axially along the length of the collar 120. In other embodiments, the collar 120 may include arms 168 having different shapes as sizes, or may include greater or fewer arms 168. For example, in one embodiment, the illustrated arms 168 are replaced by an annular ring that extending radially outward from the cylindrical body 156. The arms 168 extend through openings in the tube 68 of the nose. The arms 168 are configured to engage with the sleeve 116.

Figure 7:
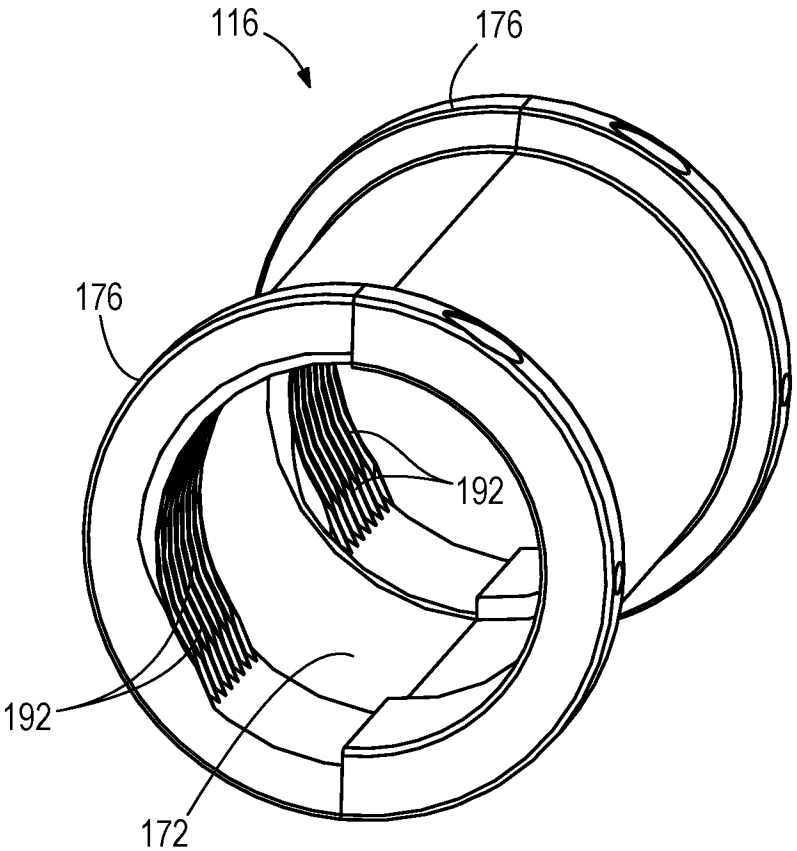
FIG. 7 is an enlarged view of a sleeve for use in the feed control mechanism of FIG. 4.

The sleeve 116 has a generally cylindrical shape with a hollow interior. The sleeve 116 is disposed around the outside of the tube 68 such that the tube 68 extends through the hollow interior. The sleeve 116 and the tube 68 are co-axial. The arms 168 extend through the openings of the tube 68 where the arms 168 are received by the sleeve 116. The sleeve 116 includes a recess 172 (FIGS. 7 and 8) sized and shaped to receive the arms 168. In the illustrated embodiments, the recess 172 is an annular recess. In other embodiments, the recess 172 can be different shapes and sizes that are configured to receive the arms 168. The sleeve 116 can slide longitudinally along the tube 68. As the sleeve 116 slides along the tube 68, the annular recess 172 engages with the arms 168 of the collar 120 to move the collar 120 with the sleeve 116. In other words, linear movement of the sleeve 116 in the direction parallel to the feed axis 80 results in linear movement of the collar 120. Additionally, in the illustrated embodiments the sleeve 116 includes a lip 176 on each rim of the sleeve 116. The lips 176 extend outwardly from the sleeve 116 to create a grip on the sleeve 116. The lips 176 help a user maintain a grip on the sleeve 116 when sliding the sleeve 116 along the tube 68.

Figure 8:
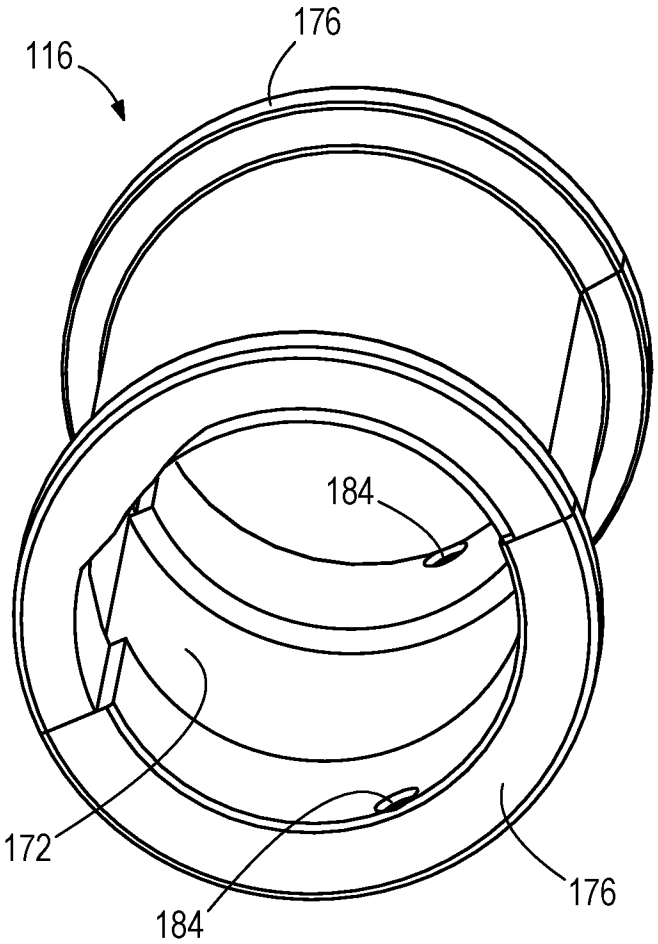
FIG. 8 is another enlarged view of the sleeve for use in the feed control mechanism of FIG. 4.

In some embodiments, the drain cleaner 20 further includes various retaining members to limit movement of the sleeve 116 with respect to the tube 68. For example, in some embodiments, the drain cleaner 20 may include retaining members that can limit movement of the sleeve in a linear direction between the first end 72 and the second end 76 of the tube 68. More specifically, in the illustrated embodiment, the sleeve 116 includes fins 192 within the interior of the sleeve 116. As shown in FIG. 8, the fins 192 may extend only partially around the interior of the sleeve 116 such that the interior circumference of the sleeve 116 includes a portion with fins 192 and a portion without fins 192. The fins 192 can selectively engage with ridges 196 (FIG. 6) on the exterior surface 86 of the tube 68 to help maintain a linear position of the sleeve 116 along the tube 68 between the first end 72 and the second end 76. In some embodiments, the fins 192 and the ridges 196 may be replaced with other types of retaining members, such as a cam surface that limits movement of the sleeve 116 with respect to the tube 68.

For example, the fins 192 and the ridges 196 can help maintain the sleeve 116 in a feed position, towards the second end 76 of the tube 68. In the illustrated embodiment, the sleeve 116 can be moved linearly along the tube 68 toward the first end 72 of the tube 68 until the ridges 196 are positioned within the interior of the sleeve 116. In particular, the sleeve 116 is oriented on the tube 68 so that the ridges 196 of the tube 68 are aligned with a portion of the sleeve 116 without fins 192. Then the sleeve 116 may be rotated relative to the tube 68 so that the fins 192 engage with the ridges 196. Once the fins 192 and the ridges 196 are engaged, the fins 192 and ridges 196 help maintain the sleeve 116 at that position relative to the tube 68. In some embodiments, the tube 68 includes multiple sets of ridges 196 that are capable of maintaining the sleeve 116 in different linear positions relative to the sleeve 116.

In addition, in some embodiments, the drain cleaner 20 may include retaining members that can limit rotation of the sleeve 116. For example, in the illustrated embodiment, the sleeve 116 includes a pair of posts 180 (FIG. 6) that are received within holes 184 (FIG. 8) in the interior of the sleeve 116. As shown in FIG. 6, the posts 180 engage with a channel 188 on the exterior surface 86 of the tube 68. The channel 188 extends parallel to the feed axis 80 between the first end 72 and the second end 76 of the tube 68. Accordingly, when the sleeve 116 slides longitudinally along the tube 68, the posts 180 can slide within the channel 188 of the tube 68. In addition, the engagement of the posts 180 and the channel 188 inhibit rotational movement of the sleeve 116 relative to the tube 68. In one embodiment, the ends of the posts 180 include detent members (not shown) that can snap into and out of the channel 188. When the detent members are engaged with the channel 188, the posts 180 guide the sleeve 116 in an axial direction and limit rotational movement of the sleeve 116. However, the sleeve 116 can be rotated by applying enough force to the sleeve 116 to snap the detent members out of the channel 188. In another embodiment, the holes 184 in the sleeve 116 that receive the posts 180 can be elongated to allow a limited amount of rotation of the sleeve 116 relative to the tube 68. Furthermore, in some embodiments, the sleeve 116 includes both the fins 192, for engaging with the ridges 196 on the tube 68, as well as the posts 180, for engaging with the channel 188 on the tube 68.

Figure 11:
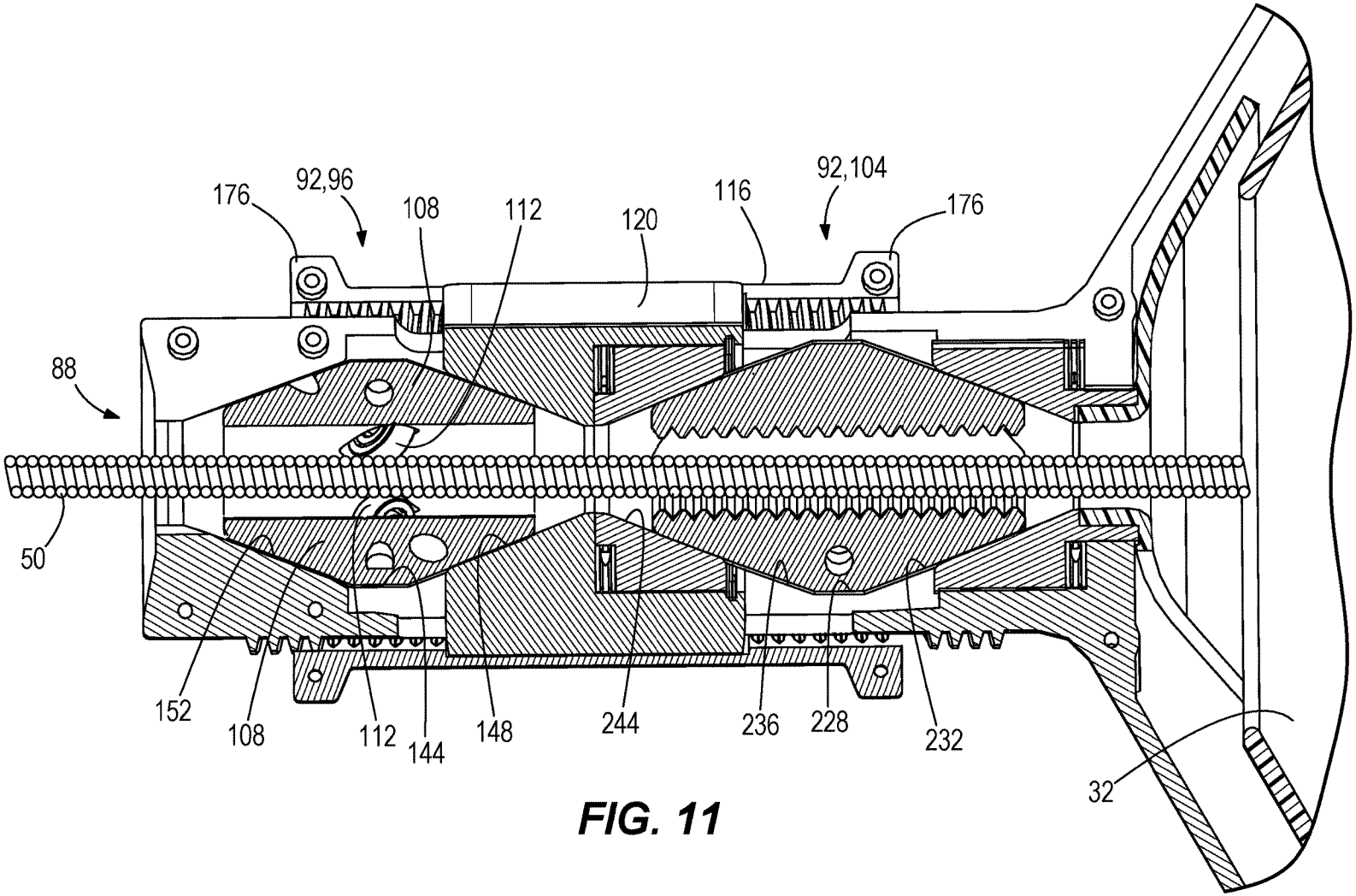
FIG. 11 illustrates the passive feed mechanism with rollers engaging a cable.

In operation, the passive feed mechanism 96 operates as follows. A user may press the actuator 56 to activate the motor 44. The motor 44 rotates the drum 32, which causes the cable 50 to rotate. Although the motor 44 drives the rotational movement of the cable 50, the motor 44 does not create linear movement of the cable 50 to feed the cable 50 in and out of the drain. The cable 50 can be moved linearly by the passive feed mechanism 96. In particular, the sleeve 116 is slid linearly in a first direction along the tube 68 from a neutral position (FIG. 5) to a feed position (FIG. 11). In some embodiments, the first direction is toward the outlet 88 of the tube 68. Linear movement of the sleeve 116 in the first direction causes linear movement of the collar 120 in the first direction. As the collar 120 moves in the first direction, the first cam surface 164 engages with the first inclined surfaces 148 of the feed wedges 108, causing the feed wedges 108 to move radially inward. In other words, linear movement of the sleeve 116 and the collar 120 creates a counter force that can overcome the outward biasing force of the springs, such that the feed wedges 108 are forced radially inward. In the illustrated embodiment, the second inclined surfaces 128 of the feed wedges 108 also engage with a retaining surface 200 formed by the interior surface 84 of the tube 68. The retaining surface 200 inhibits the feed wedges 108 from being pushed out of the tube 68. The retaining surface 200 also acts as a cam surface to help force the feed wedges 108 radially inward.

The rollers 112 move inward with the feed wedges 108. The rollers 112 will then engage with the cable 50 to feed the cable 50 into or out of the tube 68 (and the drain). Specifically, the rollers 112 frictionally engage the cable 50. Although the rollers 112 are not driven by the motor 44, the combination of the cable 50 rotation and the friction of the cable 50 with the rollers 112 cause the cable 50 to move linearly as well as rotationally. Therefore, the cable 50 can be fed into or out of the drain while still continuing to rotate. When the cable 50 is rotating in the first rotational direction, engagement of the rollers 112 feeds the cable 50 in a first linear direction. When the cable 50 is rotating in the second rotational direction, engagement of the rollers 112 feeds the cable 50 in a second linear direction. In some embodiments, the first linear direction corresponds to the extension of the cable 50 out of the drain cleaner 20 and into a drain, while the second linear direction corresponds to the retraction of the cable 50 out of the drain and into the drain cleaner 20. In some embodiments, the rotational direction of the cable 50 can be controlled by the actuator 56 and a directional switch.

In addition, in some embodiments, the sleeve 116 may be maintained in the feed position by the fins 192 of the sleeve 116 and the retaining ridges 196 on the tube 68. Accordingly, if a user does not wish to manually hold the sleeve 116 in the feed position, the user can rotate the sleeve 116 to engage the fins 192 with the ridges 196 so that the sleeve 116 remains in the feed position.

The drain cleaner 20 can also include additional feed control devices 92 to control the movement of the cable 50 into and out of the drain. For example, the feed limiting mechanism 104 can be used to inhibit linear movement of the cable 50. The feed limiting mechanism 104 may be useful when a user is trying to dislodge debris from the drain and needs to push or pull on the cable 50 without the cable 50 uncoiling from the drum 32 any further.

Referring back to FIGS. 4 and 5, the feed limiting mechanism 104 includes clamping wedges 204, a collar, and a sleeve. In the illustrated embodiment, the feed limiting mechanism 104 shares the collar 120 and the sleeve 116 of the passive feed mechanism 96. In other embodiments, the feed limiting mechanism 104 has a separate collar and sleeve than the passive feed mechanism 96. The clamping wedges 204 are positioned within the tube 68 in a similar arrangement as the feed wedges 108. Specifically, clamping wedges 204 are positioned around the feed axis 80 in a circular arrangement. The clamping wedges 204 are spaced apart from the feed axis 80 to allow enough room for the cable 50 to extend through the circular arrangement along the feed axis 80. In the illustrated embodiment, three clamping wedges 204 are used to form the circular arrangement. In other embodiments, additional clamping wedges 204 may be used.

Figure 10:
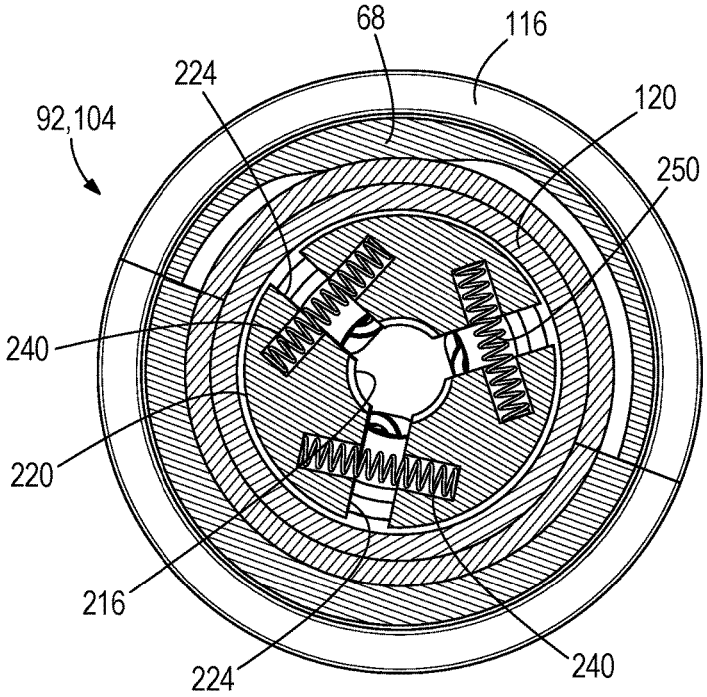
FIG. 10 is a cross-sectional view of the passive feed mechanism taken along section line 10-10 of FIG. 2.

In addition, the clamping wedges 204 have a similar shape as the feed wedges 108. Each clamping wedge 204 includes a first end 208 and a second end 212. As shown in FIG. 10, an inner wall 216, an outer wall 220, and two side walls 224 extend between the first end 208 and the second end 212. The inner wall 216 faces radially inward towards the center of the circular arrangement, and the outer wall 220 faces radially outward away from the center of the circular arrangement. The side walls 224 extend between the inner wall 216 and the outer wall 220.

Referring to FIGS. 4 and 5, the outer wall 220 of each clamping wedge 204 is curved in the direction generally perpendicular to the feed axis 80. When viewed from the direction generally parallel to the feed axis 80, the outer wall 220 includes a straight surface 228, a first inclined surface 232, and a second inclined surface 236. The straight surface 228 is generally parallel to the feed axis 80, and is located between the first inclined surface 232 and the second inclined surface 236. The first inclined surface 232 is proximate the first end 208 of the clamping wedge 204, and tapers radially inward towards the first end 208. The second inclined surface 236 is proximate the second end 212 of the feed wedges 108, and tapers radially inward towards the second end 212. As shown in FIG. 5, the inner wall 216 has a gripping surface. In the illustrated embodiment the inner wall 216 has a gripping surface that is internally threaded. The internal threads are sized and shaped to match the helical pattern of the cable 50. In other embodiments, the inner wall 216 may have other gripping surfaces. The side walls 224 are generally planar.

When in a neutral position, the clamping wedges 204 are biased radially outward. Accordingly, when in the neutral position, the side walls 224 of adjacent clamping wedges 204 are not in contact with one another and the inner surfaces 216 of the clamping wedges 204 are not in contact with the cable 50. In the illustrated embodiment, the clamping wedges 204 are biased outwardly by springs 250 that extend into bores 240 in the side walls 224 of adjacent clamping wedges 204 to hold the clamping wedges 204 apart (FIG. 10). Like the feed wedges 108, the clamping wedges 204 can be moved radially inward by a counterforce that overcomes the outward biasing force. In some embodiments, the side walls 224 of adjacent clamping wedges 204 come in contact with one another when the clamping wedges 204 are forced radially inward. In other embodiments, the side walls 224 are moved closer to one another but do not come in contact.

When the clamping wedges 204 are moved radially inward, the inner surfaces 216 of the clamping wedges 204 frictionally engage the cable 50. Frictional engagement of the cable 50 by the clamping wedges 204 inhibits linear movement of the cable 50 in the direction of the feed axis 80. Specifically, in the illustrated embodiment, the internal threads of the inner surface 216 of the clamping wedges 204 engage with the helical pattern of the cable 50. The internal threads of the illustrated clamping wedges 204 help create friction between the clamping wedges 204 and the cable 50 to inhibit linear movement of the cable 50. In other embodiments, other textures or gripping elements can be incorporated into the clamping wedges 204 to help increase the friction.

Similar to the passive feed mechanism 96, the collar 120 and the sleeve 116 can be used within the feed limiting mechanism 104 to force the clamping wedges 204 radially inward to selectively engage the cable 50. In the illustrated embodiment, the second ends 212 of the clamping wedges 204 are at least partially received within the interior space 160 of the collar 120. The interior wall of the collar 120 includes a second angled surface that forms a second cam surface 244. The second cam surface 244 is configured to align with the second inclined surfaces 236 of the clamping wedges 204, such that the second cam surface 244 and the second inclined surfaces 236 are parallel. In the illustrated embodiment, the second cam surface 244 is conical, with the widest portion of the cone opening toward the clamping wedges 204. Thus, in the illustrated embodiment, the first cam surface 164 and the second cam surface 244 faces away from one another.

As previously described, the arms 168 of the collar 120 engage with the sleeve 116 so that linear movement of the sleeve 116 creates linear movement of the collar 120. The sleeve 116 may be moved from a neutral position to a locked position (FIG. 12), in which the clamping wedges 204 are clamped onto the cable 50 to inhibit linear movement of the cable 50. In addition, the various retaining members discussed earlier may be used to limit movement of the sleeve 116. For example, the fins 192 in the sleeve 116 and the ridges 196 on the tube 68 can be used to selectively maintain the sleeve 116 in the locked position. Specifically, the sleeve 116 can be moved linearly towards the first end 72 of the tube 68 and then the sleeve 116 can be rotated to allow the fins 192 to engage with the ridge 196 to maintain the sleeve 116 in the locked position.

Figure 12:
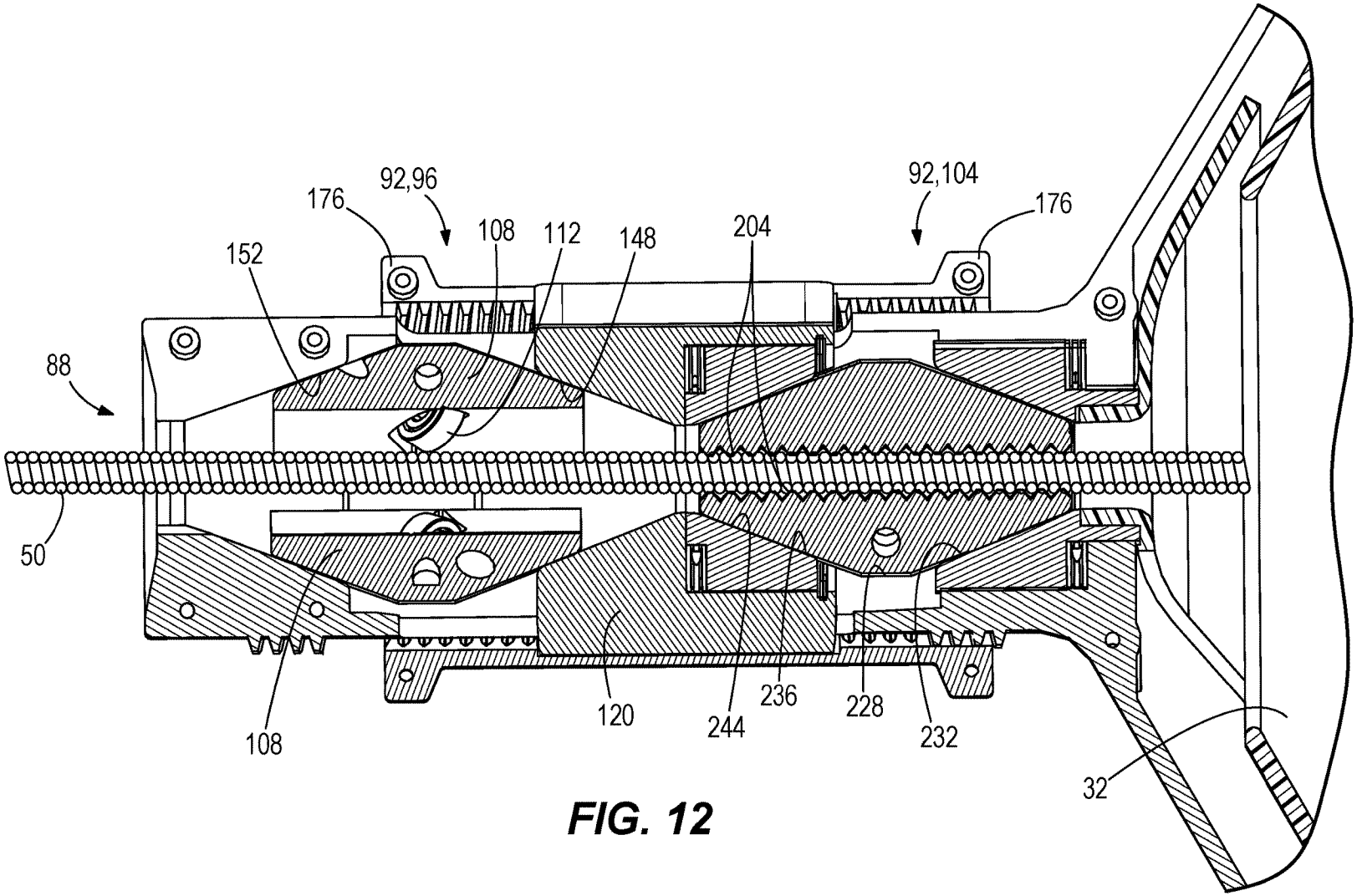
FIG. 12 illustrates the cable limiting mechanism with clamping wedges engaging the cable.
Figure 13:
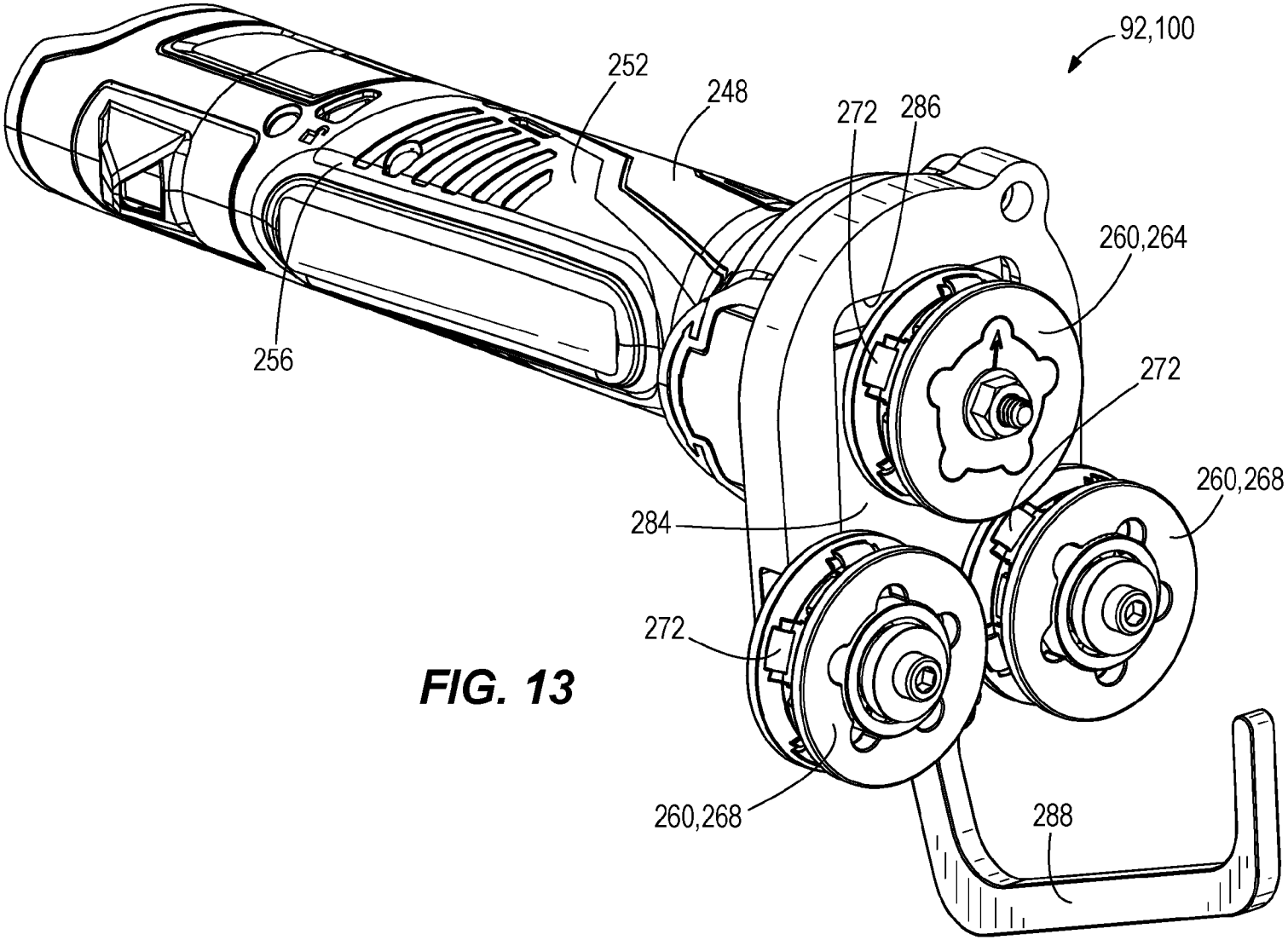
FIG. 13 is front perspective view of an active feed mechanism according to one embodiment.
Figure 14:
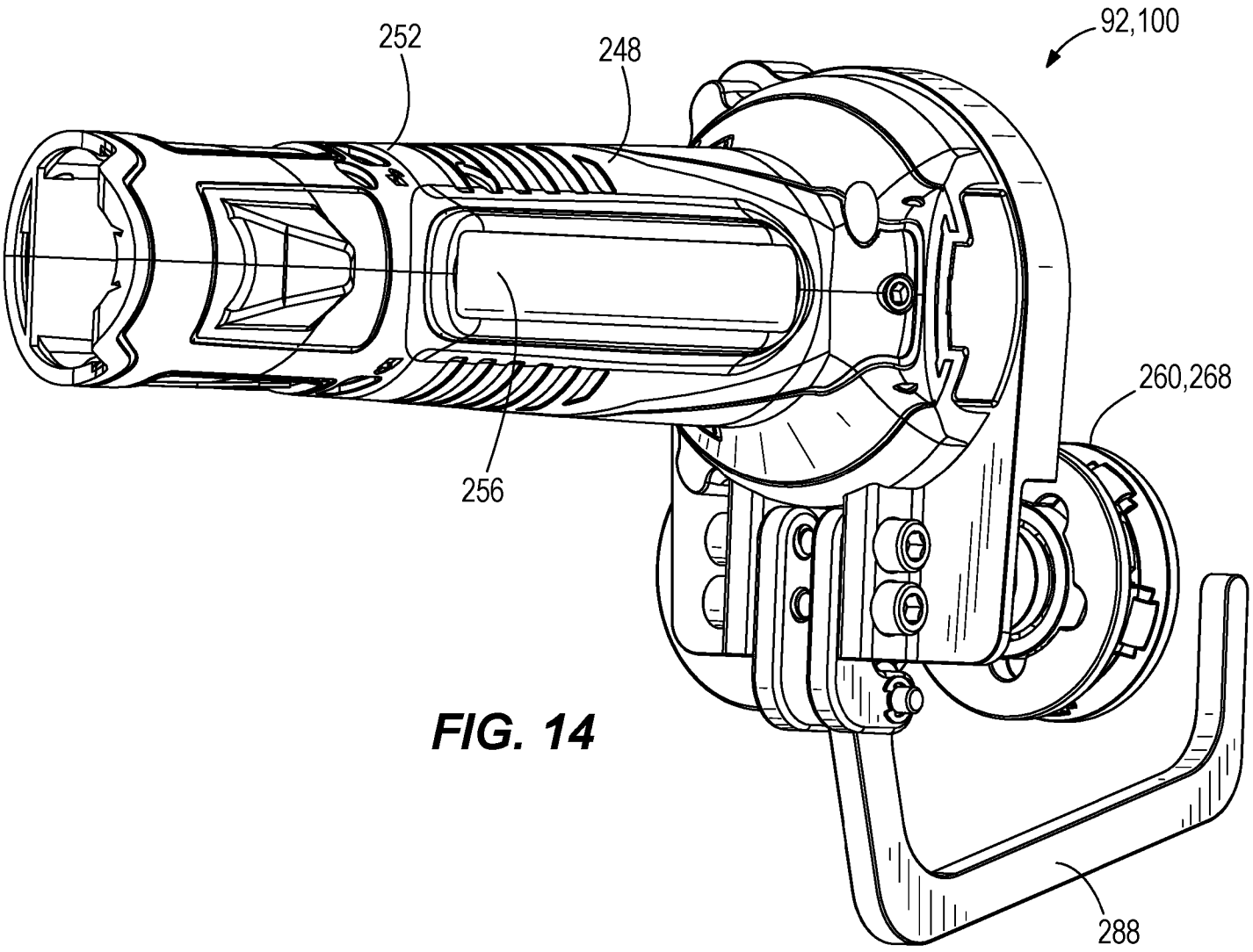
FIG. 14 is rear perspective view of the active feed mechanism of FIG. 13.

In operation, the feed limiting mechanism 104 operates as follows. A user may press the actuator 56 to activate the motor 44. The motor 44 rotates the drum 32, which causes the cable 50 to rotate. When a user wants to push or pull on the cable 50 to help dislodge debris without unwinding the cable 50 any further, the user can activate the feed limiting mechanism 104. To so do, the user slides the sleeve 116 linearly in a second direction along the tube 68 from a neutral position (FIG. 5) to a locked position (FIG. 12). In some embodiments, the second direction is toward the drum 32 (i.e., opposite the first direction). Linear movement of the sleeve 116 in the second direction causes linear movement of the collar 120 in the second direction. As the collar 120 moves in the second direction, the second cam surface 244 engages with the second inclined surfaces 236 of the clamping wedges 204, which forces the feed wedges 108 to move radially inward. In the illustrated embodiment, the first inclined surfaces 232 of the clamping wedges 204 also engage with a retaining surface 200 formed by the interior surface 84 of the tube 68. The retaining surface 200 inhibits the clamping wedges 204 from being pushed out of the tube 68 and into the drum 32. The retaining surface 200 also acts as a cam surface to help force the clamping wedges 204 radially inward.

As shown in FIG. 12, when the clamping wedges 204 move radially inward, the inner surfaces frictionally engage the cable 50 to inhibit any linear movement of the cable 50. Similar to the passive feed mechanism 96, the sleeve 116 may be rotated so that the fins 192 engage with the ridges 196 on the tube 68 to maintain the sleeve 116 in the locked position. In some embodiments, the clamping wedges 204 inhibit linear movement of the cable 50 while still allowing the cable 50 to rotate. When this is the case, the clamping wedges 204 may rotate with the cable 50 as the cable 50 rotates. In some embodiments, rotation of the clamping wedges 204 may be aided by rotating support cups 246 (FIGS. 4 and 5). One support cup 246 is positioned to receive the first ends 208 of the clamping wedges 204 and another support cup 246 is positioned to receive the second ends 212 of the clamping wedges 204. The support cups 246 can be separate components, or can be formed by other components of the drain cleaner 20. For example, in the illustrated embodiment, the support cup 246 that receives the second ends 212 of the clamping wedges 204 is formed by a portion of the collar 120. This support cup 246 also defines a portion of the second cam surface 244. In addition, the support cup 246 that receives the first ends 208 of the clamping wedges 204 forms the retaining surface 200 that prevents the clamping wedges 204 from being pushed out of the tube 68 and into the drum 32.

With reference to FIGS. 13-18, the drain cleaner 20 may include yet another feed control mechanism 92—the active feed mechanism 100. Unlike the passive feed mechanism 96, the active feed mechanism 100 uses a motor to feed the cable 50 in a linear direction. While both the passive feed mechanism 96 and the active feed mechanism 100 use the motor 44 to rotate the cable 50, the active feed mechanism 100 uses a second motor to drive the linear movement of the cable 50. In the illustrated embodiment, the active feed mechanism 100 is a separate and distinct unit from the drain cleaner 20. The active feed mechanism 100 is designed to engage the cable 50 of the drain cleaner 20 shown in FIG. 1, and assist in feeding the cable 50 into the drain. In other embodiments, the active feed mechanism 100 is integrated into the drain cleaner 20 shown in FIG. 1.

Figure 16B:
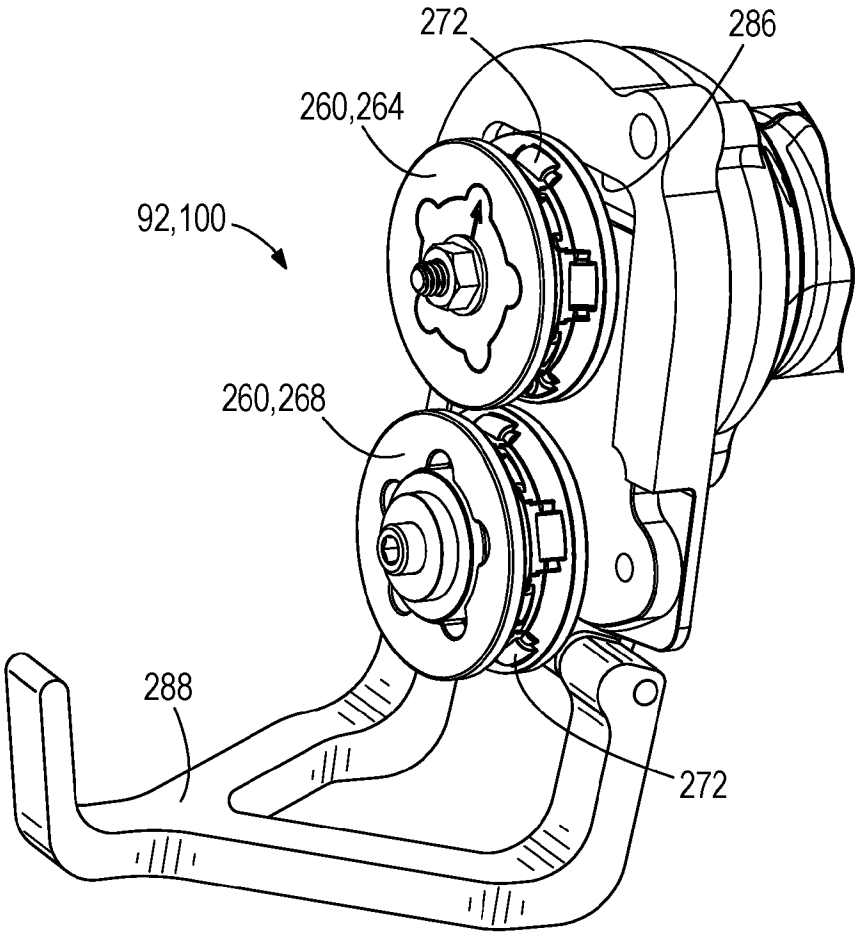
FIG. 16B is a detailed view of the active feed mechanism including another embodiment of a lever.
Figure 18:
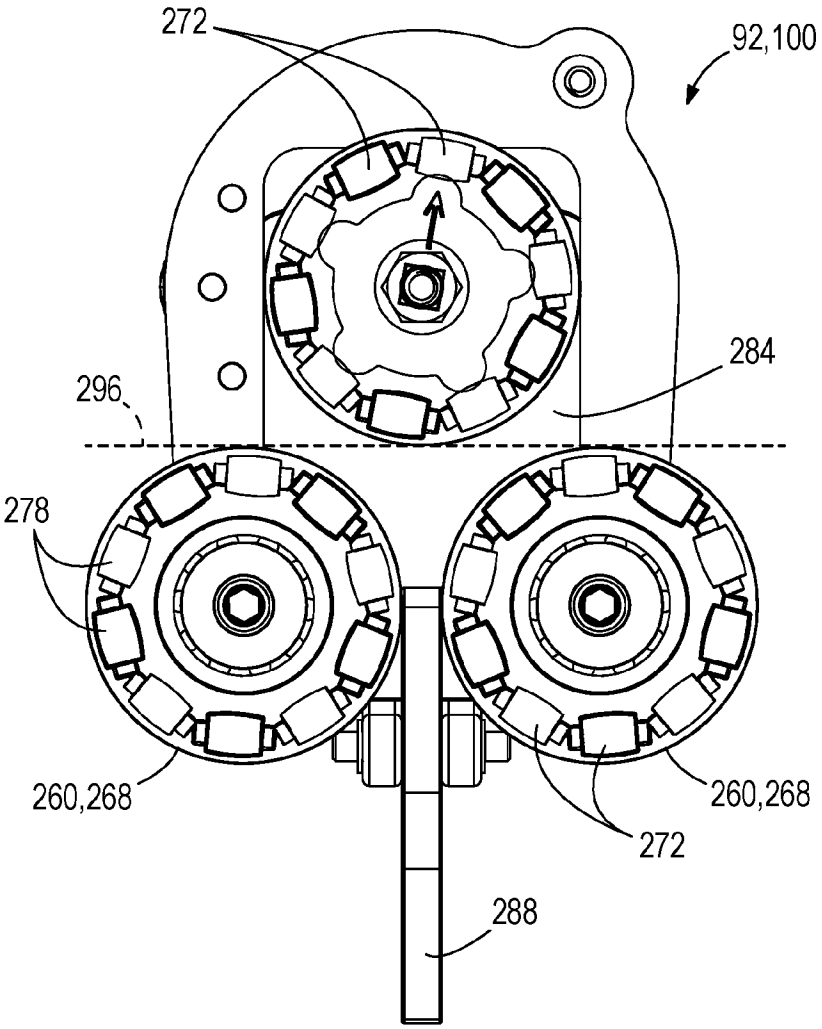
FIG. 18 is front view of the active feed mechanism of FIG. 13 with bearings showing.
Figure 17:
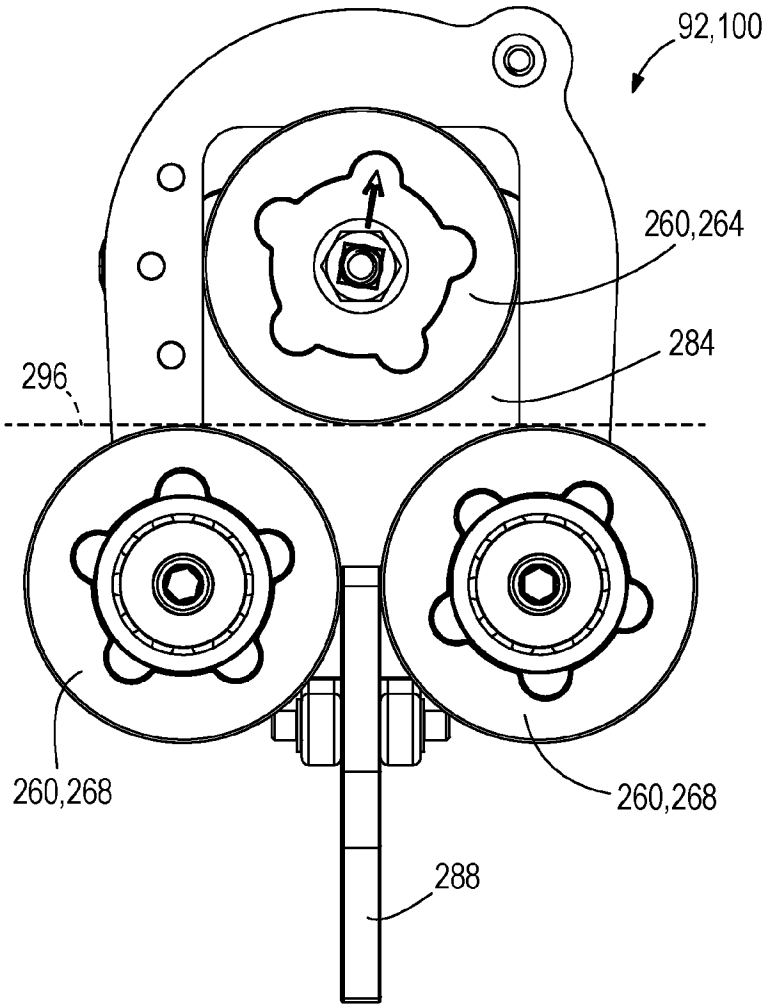
FIG. 17 is a front view of the active feed mechanism of FIG. 13.

The active feed mechanism 100 includes an elongated body 248 having a motor housing 252 that supports a second motor (not shown) and a battery receptacle 256 for receiving a battery. The second motor is configured to drive a plurality of wheels 260, which in turn, drive the cable 50 into or out of the drain. The wheels 260 are located on an end of the elongated body 248. The illustrated embodiment includes one drive wheel 264 and two driven wheels 268. In other embodiments, the second motor may drive a greater or a fewer number of wheels 260. The active feed mechanism 100 may include a greater or a fewer number of wheels 260, and the number of drive wheels 264 and driven wheels 268 may vary. For example, as shown in FIG. 16B, the illustrated feed mechanism 100 includes one drive wheel 264 and one driven wheel 268. Alternatively, the motor may drive two drive wheels 264, which in turn, drive one driven wheel 268. In further embodiments, the feed mechanism may include an arrangement of two wheels, four wheels, five wheels, six wheels, etc., with some wheels being drive wheels and some wheels being driven/idle wheels. The wheels 260 are positioned side by side and oriented with the axis of rotation 276 of each wheel 260 being generally parallel to one another. In the illustrated embodiment, the wheels 260 are positioned in a triangular configuration (FIGS. 17 and 18). The active feed mechanism 100 is positioned with the elongated body 248 extending generally perpendicular to the feed axis 80 of the drain cleaner 20. The axis of rotation 276 of the each of the wheels 260 is also generally perpendicular to the feed axis 80. This orientation allows the cable 50 to extend between the wheels 260 along the path 296 indicated by a dotted line in FIGS. 17 and 18.

Referring to FIG. 18, each wheel 260 includes a plurality of bearings 272 arranged circumferentially around the wheel 260. The number of bearings 272 on each wheel 260 may vary depending, for example, on the size of the bearings 272 and the size of the wheel 260. In addition, the type of bearing 272 can vary in different embodiments. In the illustrated embodiment, the axis of rotation of each bearing 272 is generally perpendicular to the axis of rotation 276 corresponding to each wheel 260. As shown in FIG. 16, the bearings 272 on each wheel 260 are arranged in two rows, creating a channel between the two rows of bearings 272. The cable 50 is received within the channel created by the bearings 272. Specifically, the cable 50 weaves between the wheels 260 and is engaged by the bearings 272. In other words, the cable 50 weaves through the wheels 260 in a direction perpendicular to the axis of rotation 276 of the wheels 260. In the illustrated embodiment, when the cable 50 weaves between the wheels 260, the drive wheel 264 is positioned above the cable 50 and the driven wheels 268 are positioned below the cable 50. The bearings 272 allow the cable 50 to rotate with a reduced amount of friction between the cable 50 and the circumference of the wheels 260.

Figure 19:
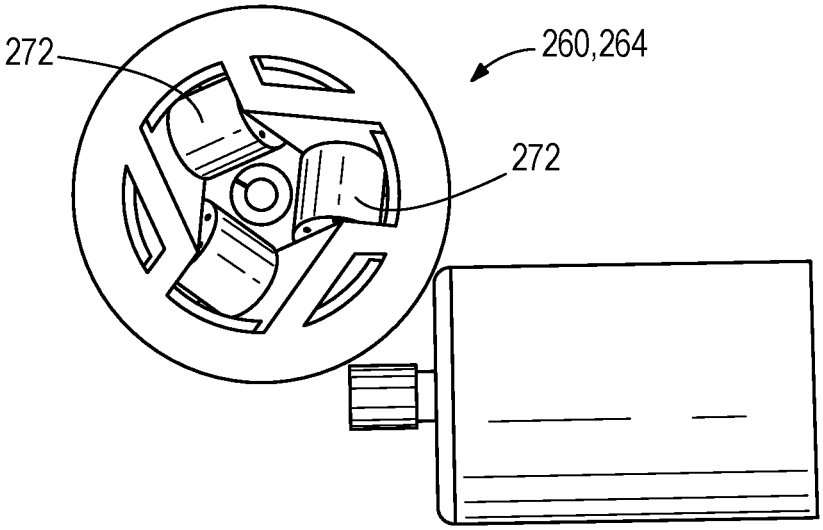
FIGS. 19-29 illustrate different embodiments of wheels and wheel engagement configurations for active feed mechanisms.
Figure 20:
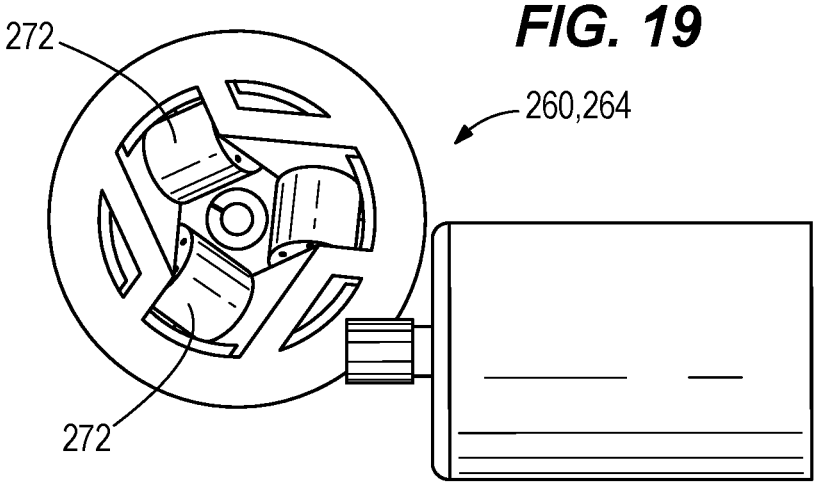
Figure 21:
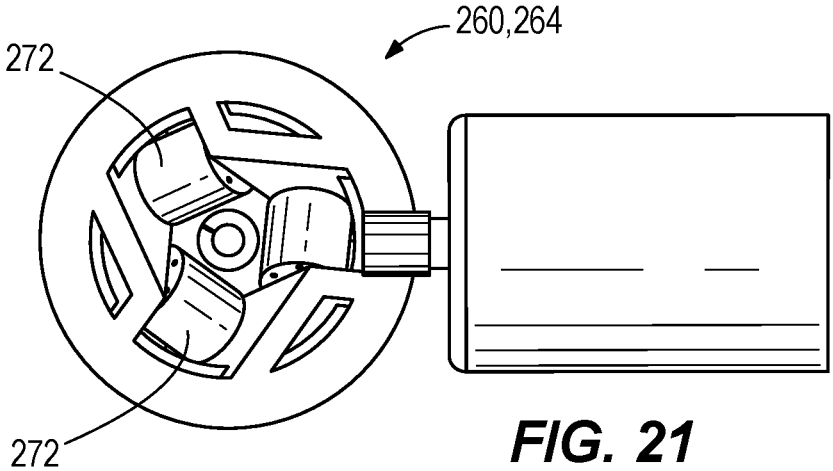
Figure 24:
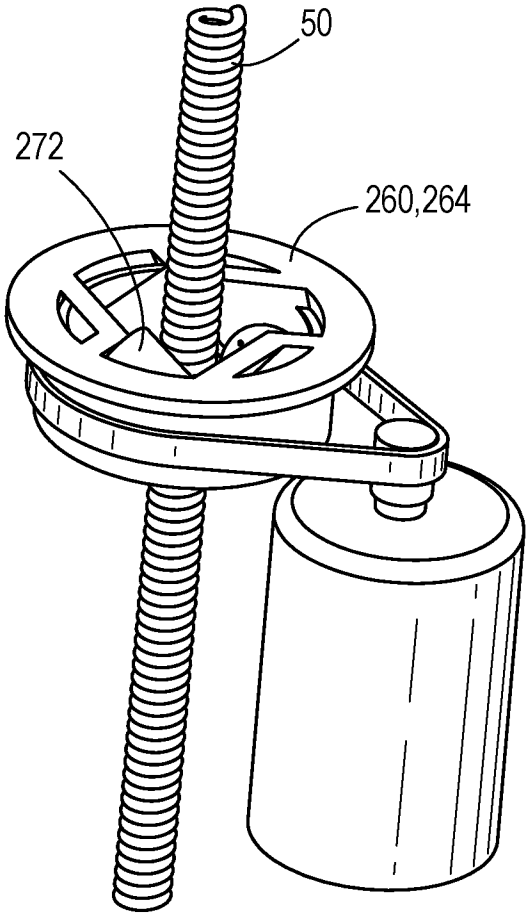
Figure 23:
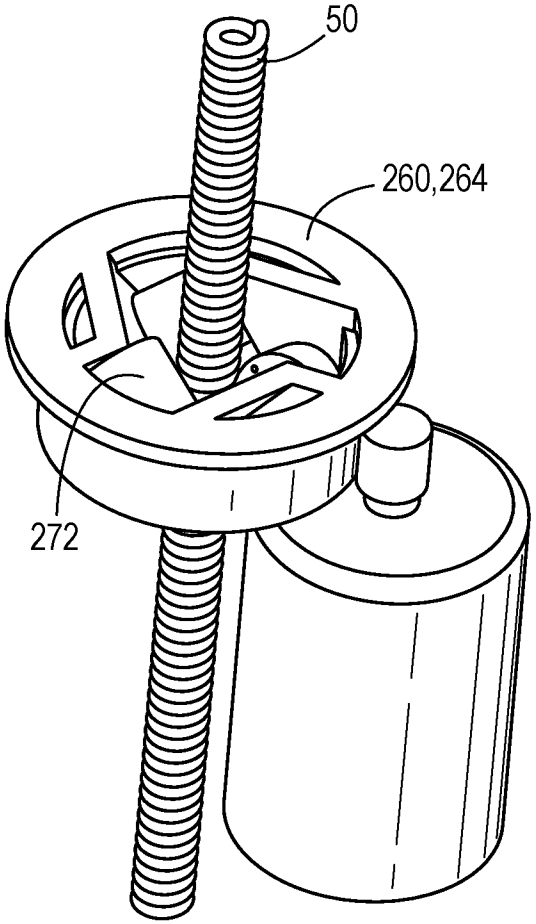
Figure 22:
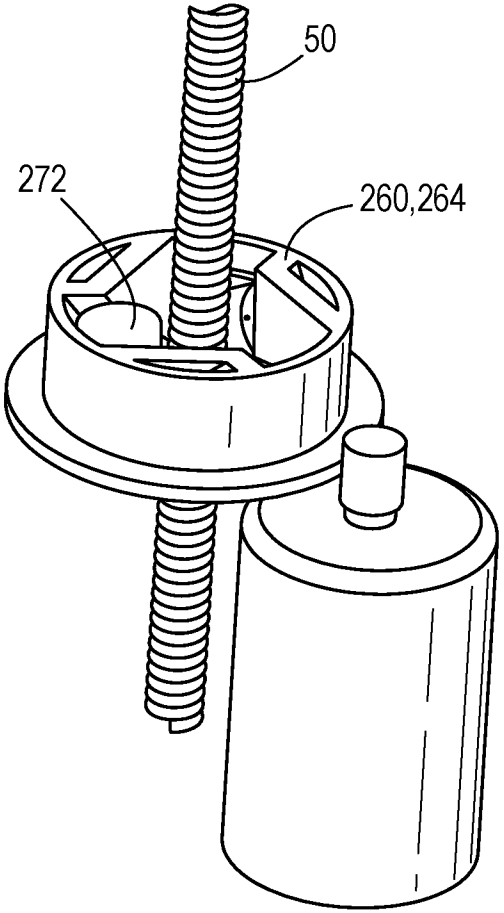
Figure 25:
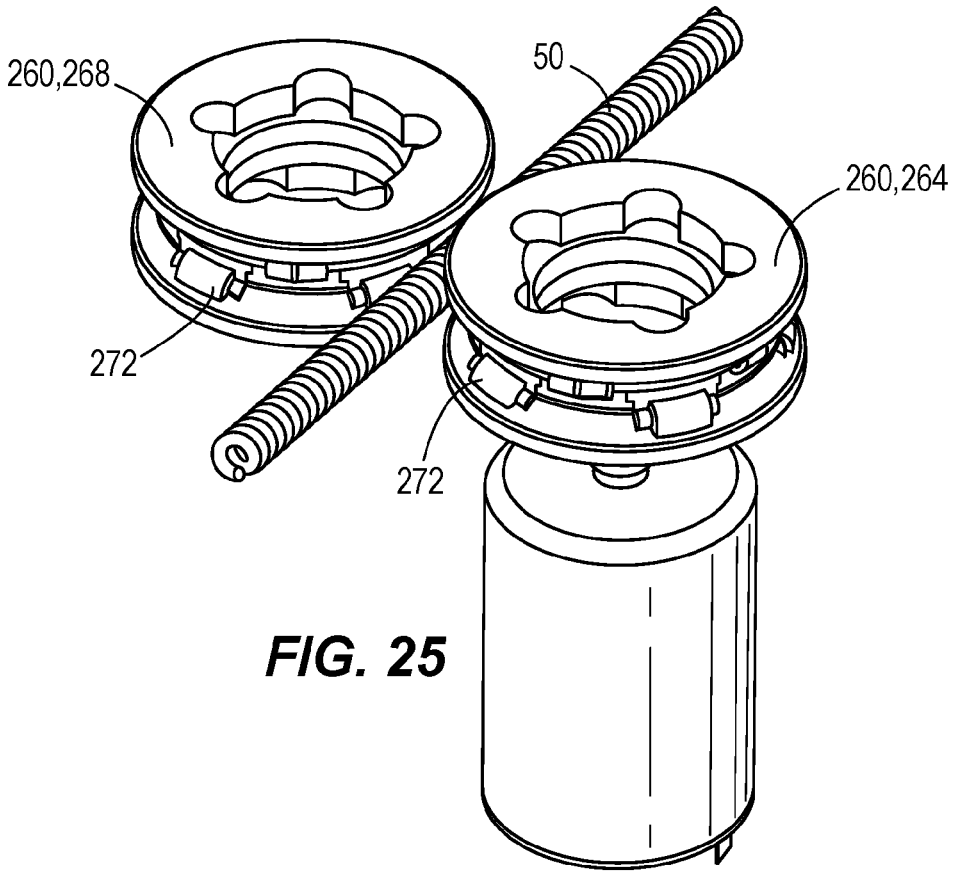
Figure 26:
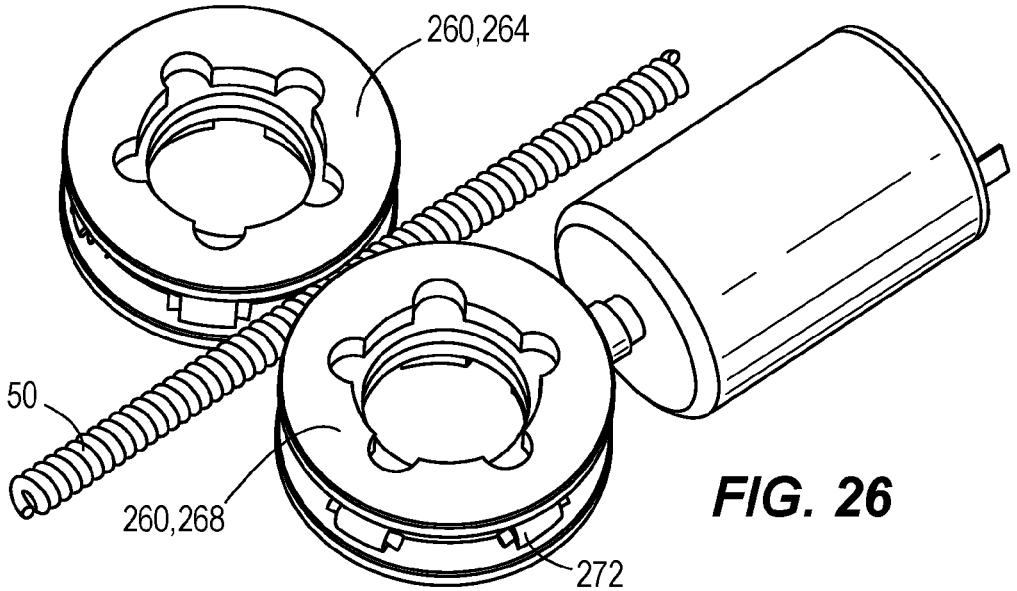
Figure 27:
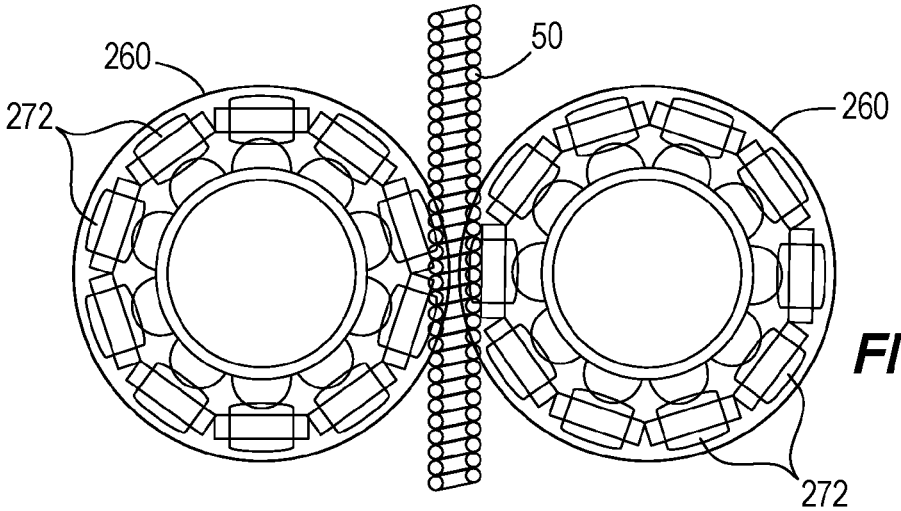
Figure 28:
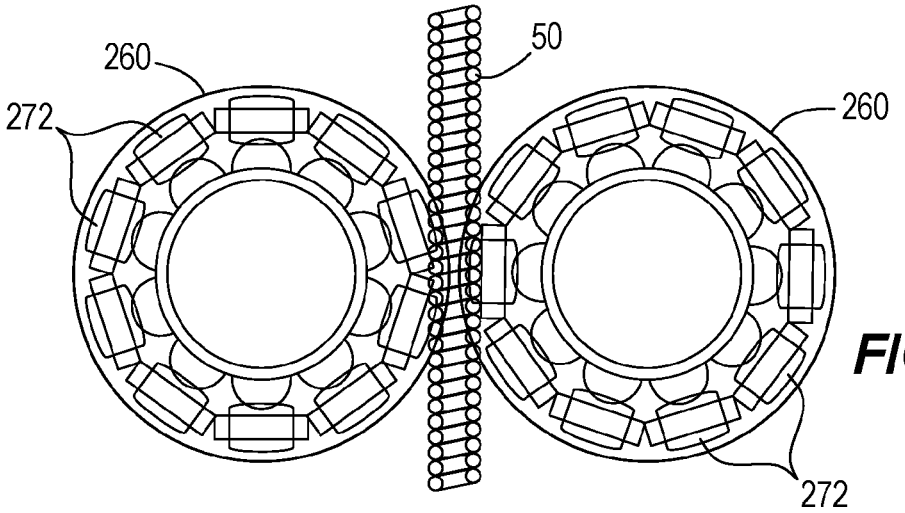
Figure 29:
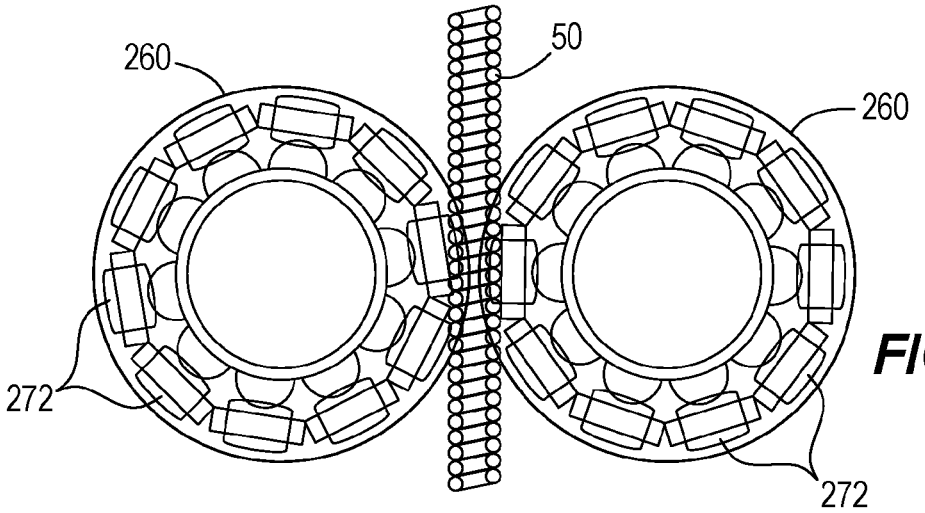

In other embodiments, the active feed mechanism 100 can include different types of wheels 260. In addition, the wheels 260 can be driven by the motor through different configurations or wheel engagement mechanisms. FIGS. 19-29 illustrate some of the different types of wheels 260 and different configurations for engaging the wheels 260 to be driven by the motor. More specifically, as shown in FIGS. 19-21 some of the different types of wheels 260 can include, but are not limited to, worm, hypoid, or bevel wheels 260. With reference to FIGS. 22-24, the wheels 260 can be engaged by the motor through a spur, a belt, a bevel, or a dual wheel configuration. In addition, the wheels 260 can be threaded, toothed, or variable timing wheels 260.

Figure 16A:
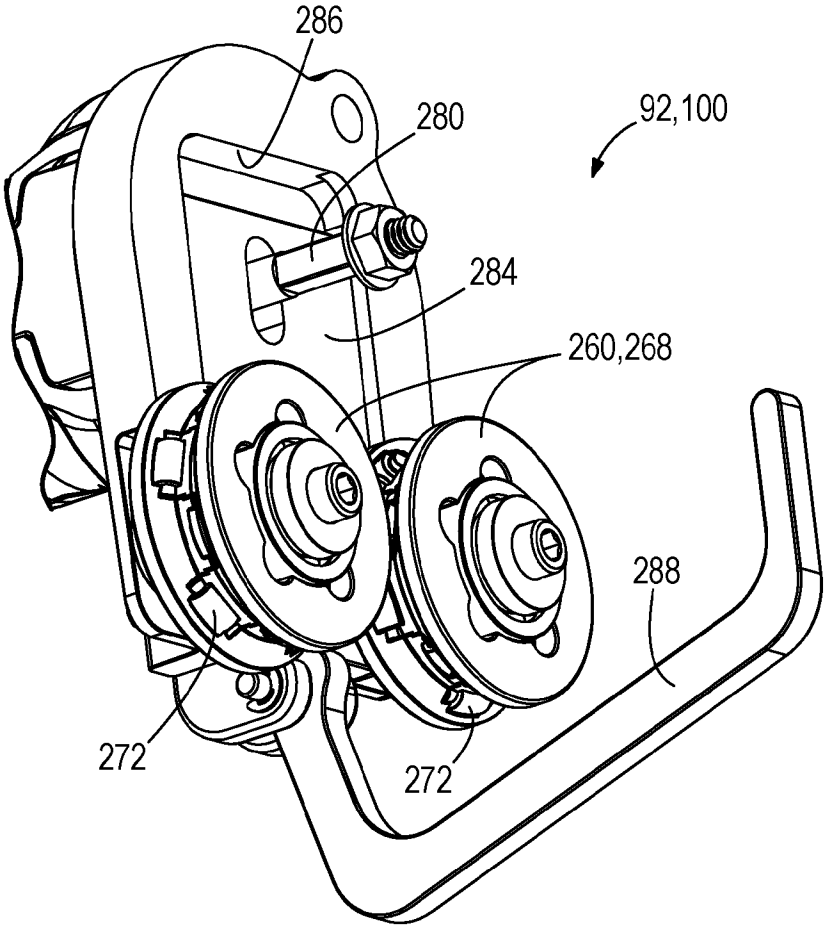
FIG. 16A is a detailed view of the active feed mechanism of FIG. 13 with a drive shaft showing.

The drive wheel 264 is driven by the second motor via a drive shaft 280 (FIG. 16A). Specifically, the second motor rotates the drive shaft 280, which, in turn, rotates the drive wheel 264. When the drive wheel 264 is engaged with the cable 50, rotation of the drive wheel 264 can drive the cable 50 into or out of the drain. The drive wheel 264 is selectively engageable with the cable 50 to selectively feed the cable 50. The driven wheels 268 are positioned on a platform 284 that is configured to move relative to the drive wheel 264. In the illustrated embodiment, the platform 284 can slide within a recess 286 in the elongated body 248. As the platform 284 slides toward the drive wheel 264, the driven wheels 268 move closer to the drive wheel 264, thereby squeezing the cable 50 between the drive wheel 264 and the driven wheels 268. The platform 284 can be adjusted to move the wheels 260 between an engaged position and a disengaged position. In the disengaged position, the platform 284 and the driven wheels 268 are positioned away from the drive wheel 264 so that the drive wheel 264 is disengaged from the cable 50. In the engaged position, the platform 284 and the driven wheels 268 are moved toward the drive wheel 264 so that the drive wheel 264 engages with the cable 50. In some embodiments, when the wheels 260 are in the engaged position, there is an overlap between the bottom edges of the drive wheel 264 and the top edges of the driven wheels 268. Accordingly, the cable 50 bends as it weaves along the path. This helps the wheels 260 tightly grip the cable 50 to drive the cable 50 forward or backward.

Figure 15:
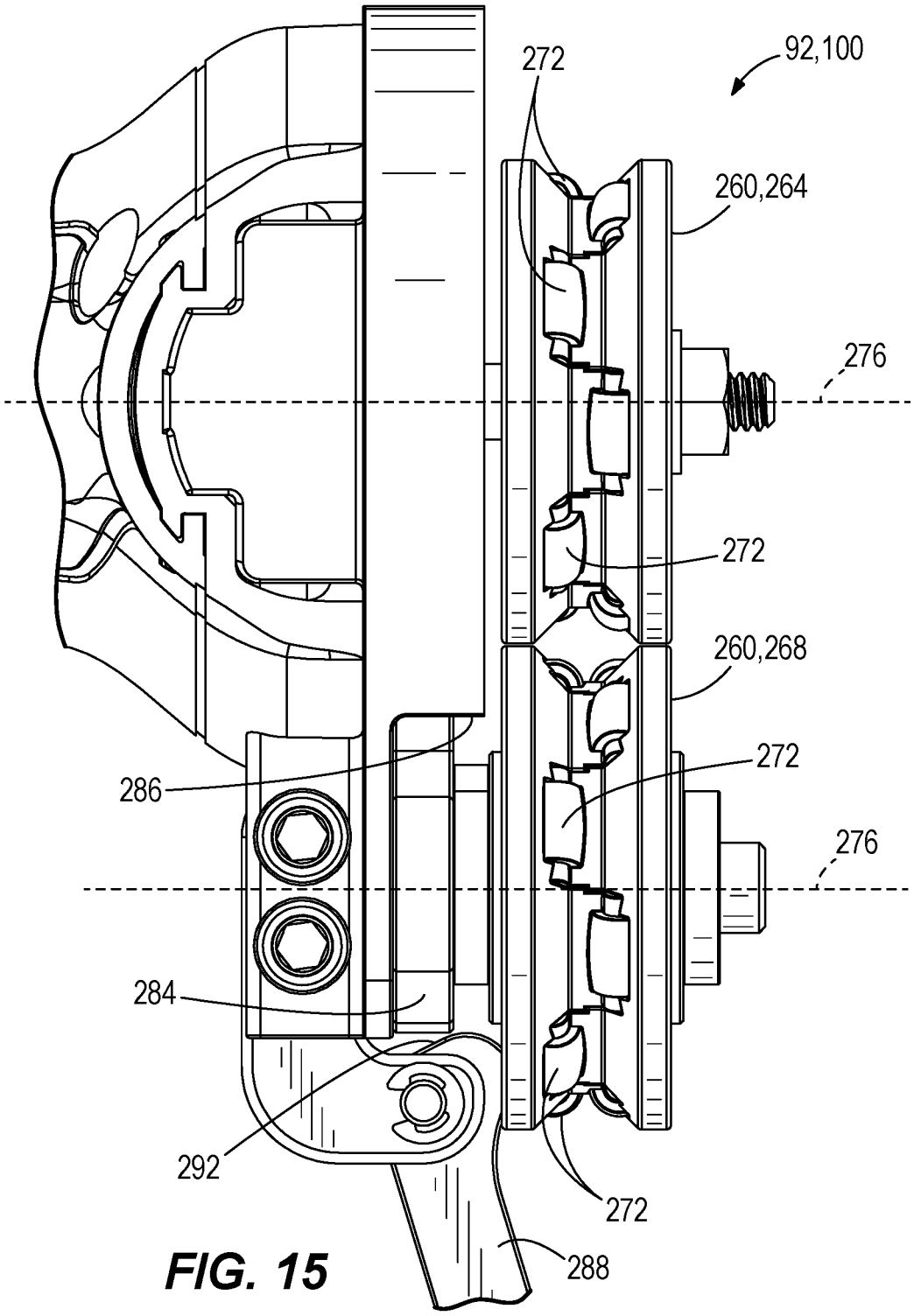
FIG. 15 is a side view of a portion of the active feed mechanism of FIG. 13.

A lever 288 is configured to slide the platform 284 toward the drive wheel 264. The lever 288 is rotatably coupled to the elongated body 248. As shown in FIG. 15, the lever 288 includes a cam surface 292 that can engage with the platform 284. As the lever 288 rotates, the cam surface 292 engages with the platform 284 and forces the platform 284 to slide toward the drive wheel 264. In particular, the lever 288 can rotate from a first position, in which the wheels 260 are in the disengaged position, to a second position, in which the wheels 260 are in the engaged position. FIGS. 16A and 16B illustrate two different embodiments of levers 288.

In operation, the motor 44 that is located in the main housing of the drain cleaner 20 rotates the drum 32, which causes the cable 50 to rotate. When the wheels 260 are in the disengaged position, the cable 50 will rotate but will not move linearly along the feed axis 80. The bearings 272 help reduce the friction between the cable 50 and the wheels 260 to allow the cable 50 to rotate more easily. The second motor drives the wheels 260, which, in turn, can drive the cable 50 forward or backward in a linear direction. More specifically, the second motor rotates the drive wheel 264. When the wheels 260 are in the disengaged position, the cable 50 will continue rotating without moving in a linear direction. To feed the cable 50 into or out of the drain, a user rotates the lever 288 to the second position to move the wheels 260 into the engaged position, in which the drive wheel 264 is in contact with the cable 50. In the engaged position, the wheels 260 move the cable 50 linearly along the feed axis 80 while still allowing the cable 50 to rotate. In some embodiments, the active feed mechanism 100 can advance the cable 50 at speeds of 5 inches or greater. In other embodiments, the active feed mechanism 100 can advance the cable 50 between 6 and 10 inches per second. In yet another embodiment, the cable 50 may be advanced 7 inches per second.

Figure 30:
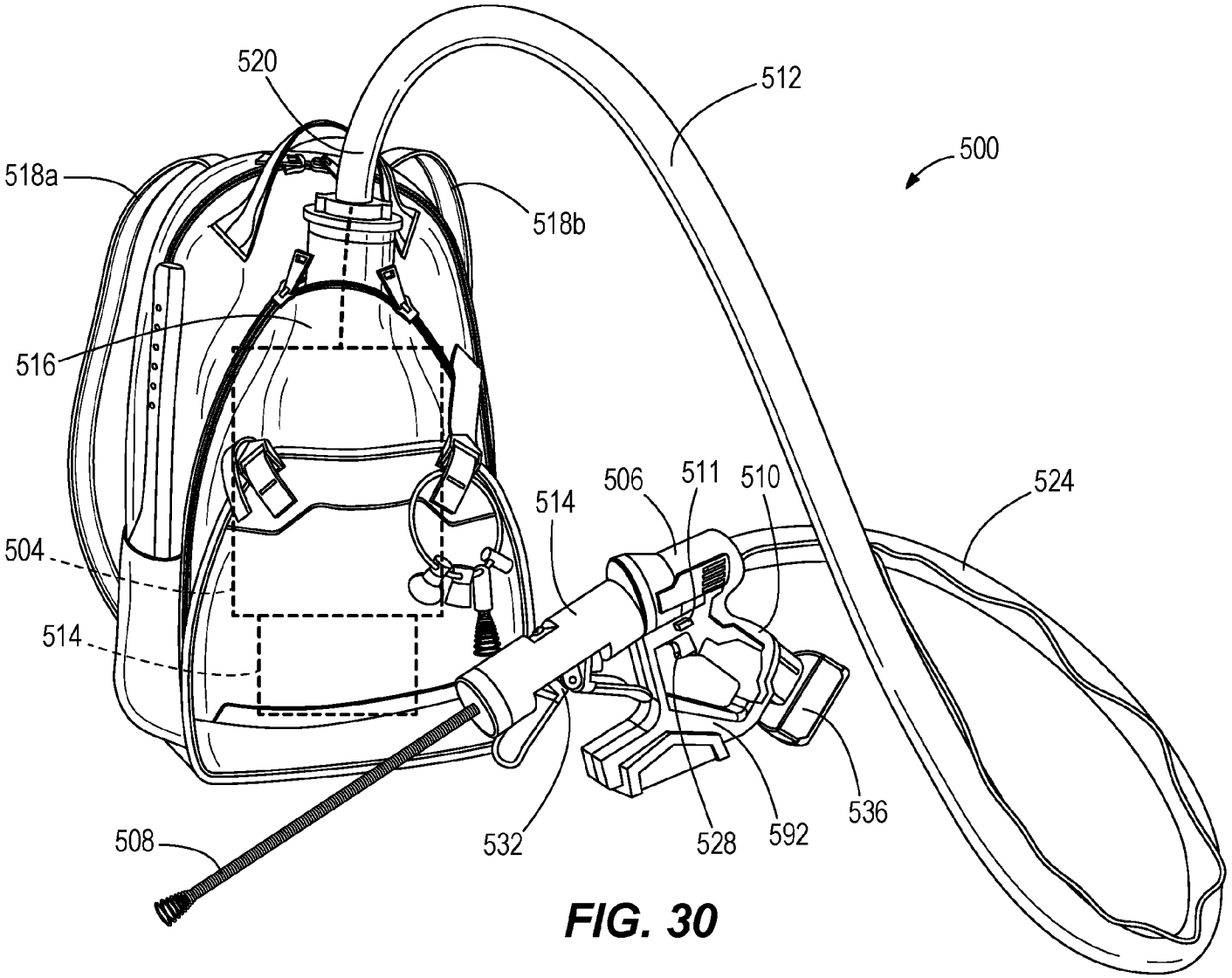
FIG. 30 illustrates a drain cleaner according to another embodiment.
Figure 31:
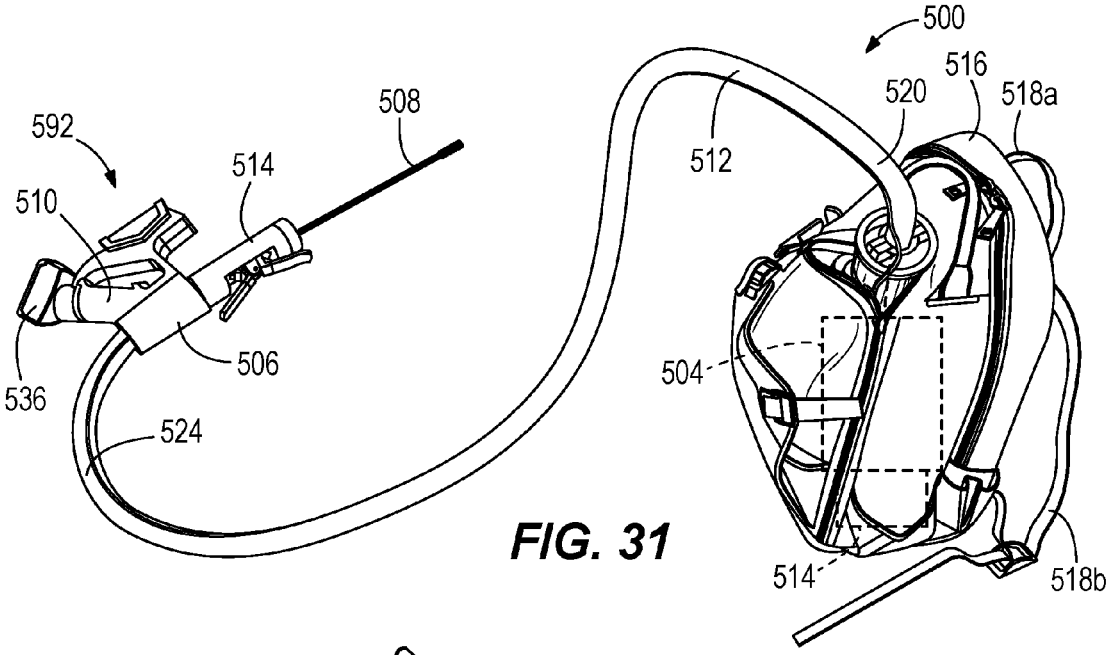
FIG. 31 illustrates a drain cleaner according to yet another embodiment.
Figure 32:
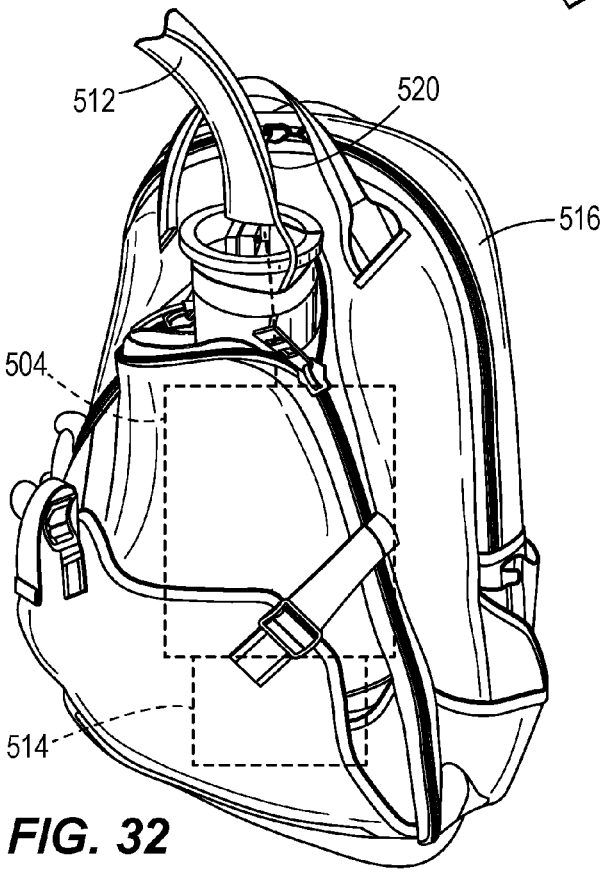
FIG. 32 illustrates a backpack for housing a drum of the drain cleaner of FIG. 31.

FIGS. 30-34 illustrate a drain cleaner 500 according to another embodiment. Referring to FIGS. 30-32, the drain cleaner 500 includes a drum 504 housed inside a carrier 516, a cable 508, a cable shroud 512, and a feed control mechanism 592. The drain cleaner 500 also includes a motor 514 and a drive mechanism (not shown) for rotating the drum 504. The drum 504 and motor 514 can be similar to the drum 32 and motor 44 shown in FIG. 3. The drum 504 and the motor 514 are configured to rotate within the carrier 516. In the illustrated embodiment, the carrier is bag, such as a soft-sided bag that can be carried by a user. More particular, the illustrated carrier is a backpack 516 having straps 518*a*, 518*b*, but could be another bag type such as an over-the-shoulder bag. The cable 508 is partially housed within the drum 504 and partially housed within the cable shroud 512. The cable shroud 512 extends between the drum 504 and the feed control mechanism 592, and includes a first end 520 proximate the drum 504 and a second end 524 proximate the feed control mechanism 592. The feed control mechanism 592 is coupled to the second end 524 of the cable shroud 512. The cable shroud 512 and the feed control mechanism 592 work together to direct the cable 508 into the drain. In use, the cable 508 extends from the drum 504, through the cable shroud 512 to the feed control mechanism 592, and into the drain.

With reference to FIGS. 30-34, the feed control mechanism 592 is a handheld unit positioned on the second end 524 of the cable shroud 512 at a distance from the carrier 516 and the drum 504. Accordingly, a length of the cable extends from the drum 504 to the feed control mechanism 592. The handheld unit is configured to be carried by the user separately from the carrier 616. The feed control mechanism 592 is coupled to the motor 514 to control operation of the motor 514 and to feed the cable 508 into and out of the drum 504.

The handheld unit includes a main body 506 having a handle 510 to be grasped by a user, and a sleeve 514 extending forwardly of the handle 510. The main body 506 includes a forward/reverse shuttle or button 511. In addition, in some embodiments, a battery 536 may be provided on the main body 506 just below the handle 510 to provide power to the feed control mechanism 592. Accordingly, the battery 536 drives the motor 514, although it is positioned remotely from the motor 514 and coupled to the handheld unit. In other embodiments, the battery 536 may be positioned elsewhere, such as within the carrier 516. In other embodiments, the drain cleaner 500 may support a power cord within the backpack or on the main body 506 of to electrically connect the motor 514 to an AC power source. The cable 508 extends through the sleeve 514 and can be directed into the drain by directing the sleeve 514 in the desired direction.

Figure 33:
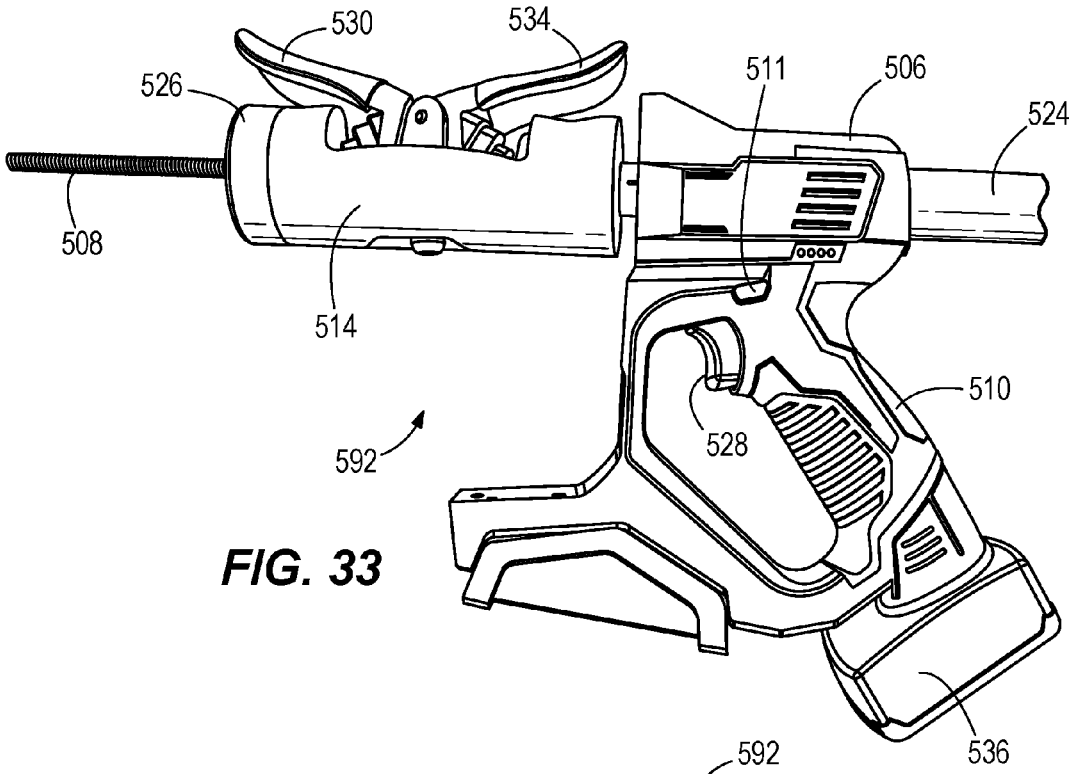
FIG. 33 is a first side view of a feed control mechanism of the drain cleaner of FIG. 31.
Figure 34:
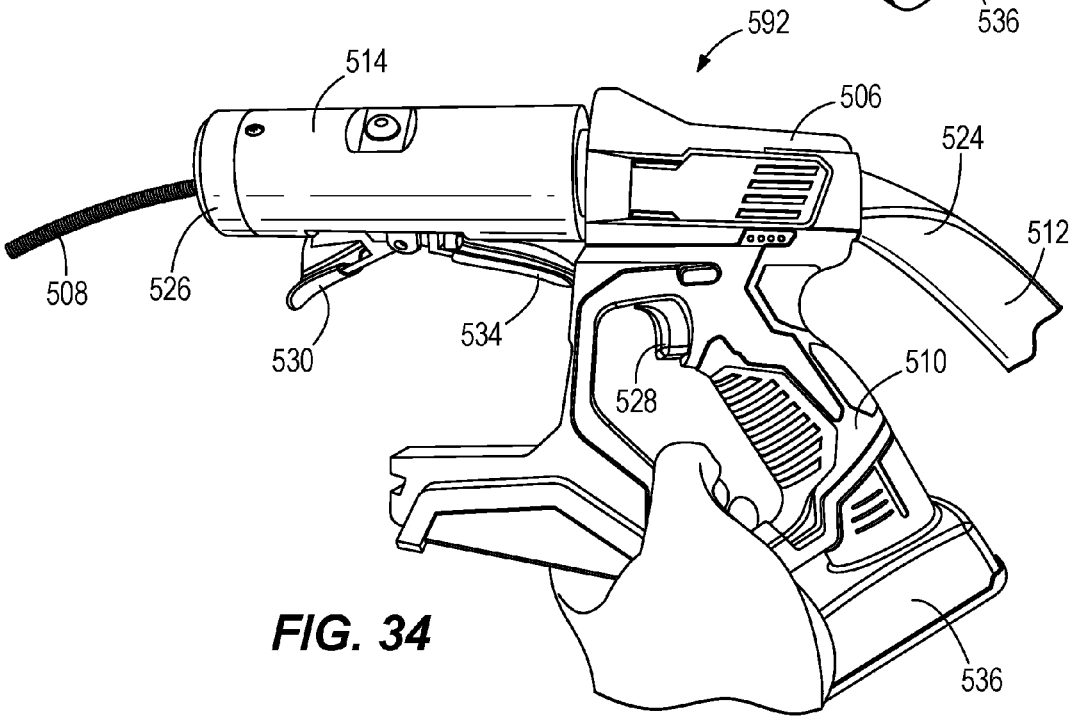
FIG. 34 is a second side view of the feed control mechanism of the drain cleaner of FIG. 31.

The feed control mechanism 592 can be used to selectively feed the cable 508 into or out of the drain. The feed control mechanism 592 may be used to control the speed and direction in which the cable 508 is fed into the drain. In particular, the feed control mechanism 592 includes an axial feed mechanism 526 capable of extending the cable 508 in a forward direction into the drain or retracting the cable 508 in a reverse direction into the drum 504. The axial feed mechanism 526 is disposed on the sleeve 514 and includes a first actuator 530 and a second actuator 534. The first actuator 530 and the second actuator 534 are aligned adjacent to one another in the axial direction of the sleeve 514. However, in other embodiments, the first actuator 530 and the second actuator 534 can be positioned in different locations on the sleeve 514, for example, on opposite sides of the sleeve 514. Additionally, the sleeve 514 can be moved or rotated about the cable 508 to reorient the axial feed mechanism 526. For example, FIG. 33 shows the axial feed mechanism 526 is an orientation above the sleeve 514, while FIG. 34 shows the axial feed mechanism 526 in an orientation below the sleeve 514. In the illustrated embodiment, when the first actuator 530 is actuated, the cable 508 is fed in the forward direction, and when the second actuator 534 is actuated, the cable 508 is fed in the reverse direction.

The feed control mechanism 592 also includes a speed control switch 528. In some embodiments, the feed control switch 528 is a trigger that is actuatable (e.g., depressible) by a user to selectively energize the motor 514 and, thereby, operate the drain cleaner 500. In particular, the speed control switch 528 is electrically coupled to the drum 504 to selectively rotate the drum 504. The speed control switch 528 controls the speed that the drum 504 and the cable 508 rotate, which in turn, controls the speed at which the cable 508 is fed in the axial direction. Thus, the speed control switch 528 can be used to control the speed that the cable 508 is feed into or out of the drain. In some embodiments, the speed control switch 528 may be a binary-type switch that rotates the drum 504, but does not alter the speed at which the drum 504 rotates. The speed control switch 528 and the axial feed mechanism 526 are both positioned on the same handheld unit of the feed control mechanism 592. By having the speed control switch 528 and the axial feed mechanism 526 in close proximity to one another, a user is able to reach both control features easily, making the overall control of the drain cleaner 500 more convenient. Additionally, by positioning the feed control mechanism 592 proximate the portion of the cable 507 that will be directed into the drain and away from the backpack 516 and the drum 504, a user can more easily access tight spaces.

In some embodiments, the feed control mechanism 592 is also operable to lock the cable 508 in place and prohibit the cable 508 from moving axially. For example, either or both of the actuators 530 or 534 could also act as the locking mechanism. Alternatively, an additional actuator 530 or 534 may be positioned elsewhere on the sleeve 514 or elsewhere on the main body 506 to actuate a lock mechanism (e.g., similar to the feed limiting mechanism 104 shown in FIG. 5). It is also contemplated that the trigger may include a locking mode.

It should be understood that the drain cleaner 500 can also include one or more of the feed control mechanisms 92 described herein, including the passive feed mechanism 96, the active feed mechanism 100, and the feed limiting mechanism 104. The feed control mechanisms 92 can be incorporated into the feed control mechanism 592 or can be positioned along other portions of the drain cleaner 500. For example, in some embodiments, the feed control mechanisms 92 can be disposed along the cable shroud 512.

Various features and advantages of the invention are set forth in the following claims.

The invention claimed is:

1. A drain cleaner comprising:
a cable configured to be inserted into a drain;
a drum supporting the cable;
a motor configured to rotate the drum; and
a cable feed control mechanism configured to feed the cable in a linear direction, the cable feed control mechanism including
a plurality of feed wedges surrounding the cable, each feed wedge having an inclined surface,
a plurality of rollers supported by the feed wedges,
a collar positioned around at least a portion of the plurality of feed wedges and having a cam surface,
a sleeve coupled to the collar and operable to move the collar in an axial direction, wherein movement of the collar in the axial direction moves the plurality of feed wedges into a feed position whereby the cam surface of the collar engages the inclined surfaces of the plurality of feed wedges to move the plurality of feed wedges radially inward and into engagement with the cable, and
a retaining member configured to selectively hold the sleeve and the plurality of feed wedges in the feed position when the sleeve is rotated.

2. The drain cleaner of claim 1, further comprising:
a handle assembly,
a shroud coupled to the handle assembly, the drum being positioned within the shroud, and
a nose assembly extending from the shroud, the nose assembly including a tube defining an axis, the cable extending from the drum through the nose assembly to an outlet of the drain cleaner.

3. The drain cleaner of claim 2, wherein the plurality of feed wedges is positioned within the nose assembly around the axis, the plurality of feed wedges being biased radially away from the cable.

4. The drain cleaner of claim 2, wherein the collar is positioned within the tube, the collar including a body that has an interior wall extending therethrough and at least one arm, the cam surface being formed by a portion of the interior wall, wherein the sleeve is disposed around an outside of the tube and includes a recess, the at least one arm of collar extending through an opening in the tube and being received by the recess.

5. The drain cleaner of claim 4, wherein the sleeve includes a plurality of fins that selectively engages with a plurality of ridges on the nose assembly.

6. The drain cleaner of claim 1, wherein the plurality of feed wedges is movable between a first position and the feed position, wherein in the first position the plurality of feed wedges is spaced apart from the cable and in the feed position the plurality of feed wedges engages the cable, and wherein in the feed position each of the plurality of feed wedges is moved closer to adjacent feed wedges than when the plurality of feed wedges is in the first position.

7. The drain cleaner of claim 1, wherein each roller is rotatably coupled to one of the plurality of feed wedges.

8. The drain cleaner of claim 5, wherein the cable extends along an axis, and wherein each roller is oriented at an oblique angle relative to the axis.

9. The drain cleaner of claim 4, wherein the sleeve moves parallel to the linear direction.

10. The drain cleaner of claim 1, wherein the cable feed control mechanism is a first cable feed control mechanism and the cam surface is a first cam surface, the drain cleaner further comprising:
a second cable feed control mechanism configured to limit linear movement of the cable, the feed control mechanism including
a plurality of clamping wedges surrounding the cable, each clamping wedge having an inclined surface, and
a collar having a second cam surface,
wherein movement of the collar towards the plurality of clamping wedges causes the second cam surface of the collar to engage the inclined surfaces of the plurality of clamping wedges to move the plurality of clamping wedges radially inward and into engagement with the cable.

11. A drain cleaner comprising:
a cable configured to be inserted into a drain;
a drum supporting the cable;
a motor configured to rotate the drum; and
a cable feed control mechanism configured to limit linear movement of the cable, the feed control mechanism including
a plurality of clamping wedges surrounding the cable, each clamping wedge having an inclined surface,
a collar positioned around a least a portion of the plurality of clamping wedges and having a cam surface,
a sleeve coupled to the collar and operable to move the collar in an axial direction, wherein movement of the collar in the axial direction moves the plurality of clamping wedges into a locked position whereby the cam surface of the collar engages the inclined surfaces of the plurality of clamping wedges to move the clamping wedges radially inward and into engagement with the cable, and a retaining member configured to selectively hold the sleeve and the plurality of clamping wedges in the locked position when the sleeve is rotated.

12. The drain cleaner of claim 11, further comprising:

a handle assembly, a shroud coupled to the handle assembly, the drum being positioned within the shroud, and a nose assembly extending from the shroud, the nose assembly including a tube defining an axis, the cable extending from the drum through the nose assembly to an outlet of the drain cleaner.

13. The drain cleaner of claim 12, wherein the plurality of clamping wedges is positioned within the nose assembly around the axis, the plurality of clamping wedges biased radially away from the cable.

14. The drain cleaner of claim 12, wherein the collar is positioned within the tube, the collar including a body that has an interior wall extending therethrough and at least one arm, the cam surface being formed by a portion of the interior wall, wherein the sleeve is disposed around an outside of the tube and includes a recess, the at least one arm of collar extending through an opening in the tube and being received by the recess.

15. The drain cleaner of claim 14, wherein the sleeve includes a plurality of fins that selectively engages with a plurality of ridges on the nose assembly.

16. The drain cleaner of claim 11, wherein the plurality of clamping wedges is movable between a neutral position and the locked position, wherein in the neutral position the plurality of clamping wedges is spaced apart from the cable and in the locked position the plurality of clamping wedges engages the cable, and wherein in the locked position each of the plurality of clamping wedges is moved closer to adjacent clamping wedges than when the plurality of clamping wedges is in the neutral position.

17. The drain cleaner of claim 11, wherein each of the plurality of clamping wedges includes an inner wall including a gripping surface that is operable to engage the cable.

18. The drain cleaner of claim 11, further comprising a cable feed control mechanism configured to feed the cable in a linear direction.

19. The drain cleaner of claim 14, wherein the sleeve moves parallel to the linear direction.

20. A drain cleaner comprising:

a cable configured to be inserted into a drain;

a drum supporting the cable;

a motor configured to rotate the drum; and a cable feed control mechanism configured to selectively feed the cable in a linear direction and limit the movement of the cable, the cable feed control mechanism including a plurality of feed wedges surrounding the cable, each feed wedge having a first inclined surface, a plurality of rollers supported by the feed wedges, a plurality of clamping wedges surrounding the cable, each clamping wedge having a second inclined surface, a collar positioned around at least portions of the plurality of feed wedges and the plurality of clamping wedges, the collar having a first cam surface and a second cam surface, a sleeve coupled to the collar and operable to move the collar, and a retaining member, wherein movement of the sleeve in a first axial direction causes movement of the collar towards the plurality of feed wedges such that the first cam surface of the collar engages the first inclined surfaces of the plurality of feed wedges to move the plurality of feed wedges radially inward to a feed position whereby the plurality of rollers engages the cable, wherein the retaining member is configured to selectively hold the sleeve and the plurality of feed wedges in the feed position when the sleeve is rotated, and wherein movement of the sleeve in a second axial direction causes movement of the collar towards the plurality of clamping wedges such that the second cam surface of the collar engages the second inclined surfaces of the plurality of clamping wedges to move the clamping wedges radially inward to a locked position whereby the plurality of clamping wedges engages the cable, wherein the retaining member is configured to selectively hold the sleeve and the plurality of clamping wedges in the locked position when the sleeve is rotated.

* * * * *